US006481602B1

(12) United States Patent
Fritze et al.

(10) Patent No.: US 6,481,602 B1
(45) Date of Patent: Nov. 19, 2002

(54) DISPENSER FOR FRANGIBLE FROZEN FOOD ARTICLES

(75) Inventors: Karl Jon Fritze, Denmark Township; Kirby Juhl Kuhlemeier, Cottage Grove; Bruce Hamilton Koerner, Red Wing; Scott Mitchell Harrison, Vadnais Heights; Donald James Hammer, St. Paul Park, all of MN (US)

(73) Assignee: RAM Center, Inc., Red Wing, MN (US)

( * ) Notice: Subject to any disclaimer, the term of this patent is extended or adjusted under 35 U.S.C. 154(b) by 0 days.

(21) Appl. No.: 09/621,213

(22) Filed: Jul. 21, 2000

Related U.S. Application Data

(62) Division of application No. 09/172,309, filed on Oct. 14, 1998, now Pat. No. 6,305,573.

(51) Int. Cl.[7] ..... B65B 43/42
(52) U.S. Cl. ..... 222/564; 222/368
(58) Field of Search ..... 222/367, 368, 222/414, 564; 99/404, 407

(56) References Cited

U.S. PATENT DOCUMENTS

| | | | | |
|---|---|---|---|---|
| 1,680,570 A | * | 8/1928 | Ripley | 222/368 |
| 1,687,155 A | * | 9/1928 | Cayot | 222/564 |
| 3,456,748 A | | 7/1969 | Allen et al. | |
| 3,758,004 A | * | 9/1973 | Garrett et al. | 222/368 |
| 3,985,266 A | | 10/1976 | Wright, Jr. | |
| 4,129,189 A | | 12/1978 | Maglecic et al. | |
| 4,460,054 A | | 7/1984 | Inkmann et al. | |
| 4,609,179 A | | 9/1986 | Chern et al. | |
| 4,804,113 A | * | 2/1989 | Ciaccio | 222/142.1 |
| 4,922,435 A | | 5/1990 | Cahlander et al. | |
| 4,979,864 A | | 12/1990 | Cahlander et al. | |
| 5,052,288 A | | 10/1991 | Marquez et al. | |
| 5,054,934 A | * | 10/1991 | Kintz | 222/368 |
| 5,104,002 A | | 4/1992 | Cahlander et al. | |
| 5,132,914 A | | 7/1992 | Cahlander et al. | |
| 5,172,328 A | | 12/1992 | Cahlander et al. | |
| 5,191,918 A | | 3/1993 | Cahlander et al. | |
| 5,211,375 A | | 5/1993 | Wang | |
| D337,021 S | | 7/1993 | Boerto et al. | |
| 5,244,020 A | | 9/1993 | Bruno et al. | |
| 5,249,914 A | | 10/1993 | Cahlander et al. | |
| 5,282,498 A | | 2/1994 | Cahlander et al. | |

(List continued on next page.)

FOREIGN PATENT DOCUMENTS

| | | |
|---|---|---|
| EP | 0 455 477 A2 | 11/1991 |
| EP | 0 488 351 A1 | 6/1992 |
| GB | 830685 | 3/1960 |

*Primary Examiner*—J. Casimer Jacyna
(74) *Attorney, Agent, or Firm*—Merchant & Gould P.C.

(57) ABSTRACT

The present invention provides a method and apparatus for dispensing articles into a container or basket and for controlling the dispensing mechanism to more accurately, efficiently, and intelligently dispense the desired articles with less damages to the articles. The dispenser includes a primary storage location which can take the form of a bulk storage hopper, an accumulator storage location into which the dispensed articles are transferred during the dispensing of the articles. A reversing drum and a flexible, resilient diverter are configured and arranged to reduce article breakage and/or to transfer different types of articles. The diverter apparatus is detachably mounted on an inside wall of the hopper body. The drum is also designed to provide a self-alignment between the drum and a motor shaft when the drum is mounted onto the drum motor shaft. A load/weight sensing/measuring assembly accurately and intelligently weighs the articles in the accumulator by an adaptive weighing method. The load/weight sensing/measuring assembly includes a spring to convert force to displacement and a solid-state sensor/magnet mechanism to replace the expensive load cell assembly.

17 Claims, 20 Drawing Sheets

U.S. PATENT DOCUMENTS

| | | | | | |
|---|---|---|---|---|---|
| 5,353,847 | A | | 10/1994 | Cahlander et al. | |
| 5,381,702 | A | | 1/1995 | Ohno | |
| 5,404,797 | A | * | 4/1995 | Millar | 99/407 |
| 5,419,239 | A | | 5/1995 | Covington et al. | |
| 5,551,604 | A | * | 9/1996 | Kern et al. | 222/368 |
| 5,695,173 | A | | 12/1997 | Ochoa et al. | |
| 5,778,767 | A | | 7/1998 | Rudesill | |
| D402,853 | S | | 12/1998 | Fritze et al. | |
| H1823 | H | | 12/1999 | Wolford | |
| 6,089,544 | A | | 7/2000 | Ellis | |
| 6,125,894 | A | | 10/2000 | Fritze et al. | |
| 6,131,622 | A | | 10/2000 | Fritze et al | |

* cited by examiner .

DISPENSER FOR FRANGIBLE FROZEN FOOD ARTICLES

This application is a divisional of application Ser. No. 09/172,309, filed Oct. 14, 1998, now issued as U.S. Pat. No. 6,305,573 B1, which application is incorporated herein by reference.

FIELD OF THE INVENTION

This invention relates generally to dispensing; more particularly to dispensing food items; and more particularly still to an intelligent efficient dispensing unit for dispensing frozen food items.

BACKGROUND OF THE INVENTION

Frozen french fry dispensers are known in the art. An example is disclosed in U.S. Pat. No. 5,282,498 issued to Cahlander et al; U.S. Pat. No. 5,353,847 issued to Cahlander et al; and U.S. Pat. No. 5, 191,918 issued to Cahlander et al. Each of the foregoing patents discloses a french fry dispenser which includes a main storage bin, a device for moving the fries from the main storage bin into a secondary location, a means for holding the fries in the secondary location, and a complex apparatus for moving empty cooking baskets into position under the secondary storage location.

While the disclosed dispenser automates the process of dispensing frozen articles and has been successful in the marketplace, there are several areas in which the dispenser may be improved. First, the complex apparatus used for automatically moving the plurality of baskets into position under the secondary position is often not needed and/or desired by the end-user. Further, in such instances, providing such a device introduces unnecessarily complex and expensive equipment into the dispenser.

Second, the manner in which the disclosed apparatus determines the weight of the articles to dispense does not provide highly accurate results (e.g., dispensing by time and by volume may be non-linear based in part upon the articles dispensed). To solve the problem a load cell is often used to accurately measure the weight of the articles. However, such a load cell is usually an expensive piece of equipment which adds more expense into the dispenser apparatus. Accordingly there is a need for an inexpensive and accurate load/weight measuring device.

Third. the device for moving the fries from the main storage bin into the secondary location may be clogged by large clumps of fries thus causing breakage of the fries. Further, in some instances, articles which have different characteristics from fries are desired to be dispensed. Accordingly, a controllable device is needed to resolve this problem.

Fourth, the manner in which the disclosed apparatus dispenses does not have an efficient dispensing rate for various types of food products or articles. More specifically, the dispensing rate is either too fast which causes difficulty in stopping at an accurate weight or too slow which extends to an unreasonable time. The fundamental problem is that a dense product or product with a large weight per particle, if dispensed rapidly, cannot be stopped at an accurate weight, for example, due to the weight of product in flight, i.e. the weight of the product which has not reached the weighing mechanism but has been dispensed. Thus, there is a need to dispense the product at an appropriate rate, e.g. at a rate which reacts to the approaching target weight. Another associated problem is that if the load/weight sensing/ measuring assembly operates at a rate appropriate to a denser product, a weighing cycle may be extended to an unreasonable time, e.g. four to six times the cycle for a heavier product. Thus, there is a need for a controllable weighing mechanism to provide an appropriate dispensing rate based on the weight of articles dispensed. Such an improved dispenser apparatus should also provide for accurate weighing by taking into account differences in each different dispenser unit and characteristics of the articles dispensed, i.e. the weighing mechanism should learn over time, e.g. several dispensing cycles, to account for such discrepancies.

Fifth, it is often desired to limit the defrosting/thawing of the frozen articles. In many cases, however, the frozen articles to be dispensed from the disclosed apparatus are easily defrosted or thawed, especially when the dispenser is the near cooking area. Accordingly, there is a need for an air restricting mechanism implemented in the apparatus to help slow the defrosting/thawing of the frozen articles.

Sixth, the disclosed apparatus is adapted for dispensing frozen fries. The disclosed apparatus is not configured and arranged to dispense other articles, such as onion rings, drummies, or even different sized frozen fries, etc. Therefore, there is a need for an improved dispenser apparatus which is configured and arranged to dispense a variety of food products or articles.

SUMMARY OF THE INVENTION

The present invention provides for a reliable method and apparatus for dispensing articles and controlling the dispensing mechanism to more accurately dispense the desired articles. Such control may also be expanded to learn over time to modify the control to achieve even greater accuracy.

In a preferred embodiment constructed according to the principles of the present invention, the apparatus for dispensing food articles from a primary storage holding area to a basket includes: a primary food article storage location and an accumulator food article storage location arranged and configured proximate to the primary food article storage location. The food articles fall by gravity to a basket which is generally located beneath the accumulator food article storage location. A rotatable, reversible drum controllably transfers the food articles from the primary to the accumulator food article storage location in response to a control signal. An accumulator door controllably dispenses the food articles from the accumulator food article storage location to the basket in response to a control signal. The control signals are generated by a controller.

In one aspect of the invention, the drum motor is reversed in its rotation direction upon detection of a predetermined current increase and/or a predetermined speed decrease of the drum motor. After a predetermined period of time or turn, the drum motor is rotated forward again in its normal dispensing direction. One advantage of this aspect of the present invention is that it significantly reduces food breakage and can be adapted for various types of food articles (e.g., in one example, frangible frozen food items).

In another aspect of the invention, the articles in the accumulator food article storage location are retained in that area by the accumulator door. The accumulator door is selectively operated between open and closed positions. A load/weight measurement device is arranged and configured to weigh the articles retained by the accumulator door in real time. In a preferred embodiment, a spring is used to convert the load/weight to displacement. By sensing the displacement with a sensor and sending the sensed weight signal to the controller, the controller calculates the load/weight of the articles in the accumulator food article storage location. When a desired or predetermined weight is reached, the controller signals the drum motor to reduce the dispensing rate and stop. The accumulator door may be selectively opened automatically upon reaching the desired weight and detecting the presence of the basket or may be operated by a user when desired.

A further aspect of the present invention is that an adaptive weighing method is utilized in the controller during the weighing/measuring process of the articles in the accumulator storage location. One advantage of using the adaptive weighing method is that it optimizes the dispensing rate by adjusting its dispensing rate to match a predetermined rate. The controller monitors in real time the sensed weight signal from the load sensor and operates the drum motor to control the articles dispensed into the accumulator area to a predetermined level. Thus, by monitoring the movement of the drum and the weight of the transferred articles, the controller can determine the manner in which the drum should be moved in a future dispensing cycle so as to increase the accuracy of the dispensed articles. Accordingly, the adaptive weighing method not only resolves the problem mentioned before but also allows an accurate, intelligent, efficient dispensing process.

An additional aspect of the present invention is that it significantly improves the food handling mechanism. First, a flexible diverter is used to flexibly control the distance between the drum and the diverter. It allows a larger article to go through the space between the drum and the diverter without necessarily letting many other smaller articles uncontrollably pass through at one time. Further, it allows various types of articles to be dispensed with significantly less breakage. Second, the drum is arranged and configured to have a number of raised areas with different heights and land areas. Third, air restricting members are provided between a hopper lid and a hopper body and between the hopper and the accumulator. Fourth, the accumulator door is arranged and configured to include two flaps, one of which extends over the other at their connecting end to reduce/restrict the air flow entering into or exiting out of the accumulator.

A further additional aspect of the invention is that the accumulator is separate from the hopper. The accumulator is preferably mounted on a frame or housing of the dispenser apparatus. One advantage of such feature is that the accuracy of the weight measurement of the articles in the accumulator storage location is improved. It will be appreciated that in the prior art systems, some of the food articles may reside within the accumulator area and some may extend up into the hopper. Because friction may exist between these latter items and the walls of the hopper, the accuracy of the weight measurement may be improved (and variability reduced) by separating the accumulator from the hopper as in the preferred embodiment of the present invention.

A yet another aspect of the invention is that one end of the drum is arranged and configured to have a twist entrance for mounting the drum onto the drum motor shaft. The twist entrance provides a self-alignment for the drum to slide onto the drum motor shaft. The advantage of the self-alignment is that a user does not have to reach inside the hopper to adjust the drum position while placing the hopper onto the dispenser apparatus, especially when the hopper contains a full load of articles.

According to yet another aspect of the invention, there is provided a method of dispensing articles. The method includes: loading the articles into a primary article storage location; initiating a dispense signal; controllably transferring the articles to an accumulator article storage location in response to a control signal, the control signal being adjusted in real time in accordance with a rotation speed and/or a sensed current of a transfer assembly, the accumulator article storage location including an accumulator door arranged and configured to selectively open upon receipt of an accumulator door open signal, wherein the articles fall by gravity to a shelf, generally located beneath the accumulator door; weighing the articles in the accumulator article storage location in real time and generating a weigh signal; receiving the weigh signal. comparing the received weigh signal to a predetermined weigh value, and adjusting the control signal; and generating the accumulator door open signal.

While the invention will be described with respect to a preferred embodiment onfiguration and with respect to particular components, it will be understood that the invention is not to be construed as limited by such configurations or components. Further, while the preferred embodiment of the invention will be described in relation to dispensing frozen french fries and to the method applicable to using a controller to dispense at greater accuracy, it will be understood that the scope of the invention is not to be limited by this environment in which the preferred embodiment is described herein.

These and various other advantages and features which characterize the invention are pointed out with particularity in the claims annexed hereto and forming a part hereof. However, for a better understanding of the invention, its advantages and objectives obtained by its use, reference should be had to the drawings which form a further part hereof and to the accompanying descriptive matter, in which there is illustrated and described a preferred embodiment to the invention.

BRIEF DESCRIPTION OF THE DRAWINGS

Referring to the drawings wherein like numerals represent like parts throughout the several views.

DETAILED DESCRIPTION OF THE PREFERRED EMBODIMENT

The present invention provides for a reliable method and apparatus for dispensing articles and controlling the dispensing mechanism to more accurately dispense the desired articles. Such control may also be expanded to learn over time to modify the control to achieve even greater accuracy.

In the following description of the exemplary embodiment, reference is made to the accompanying drawings which form a part hereof, and in which is shown by way of illustration the specific embodiment in which the invention may be practiced. It is to be understood that other embodiments may be utilized when structural and other changes may be made without departing from the scope of the present invention.

Figure 1:
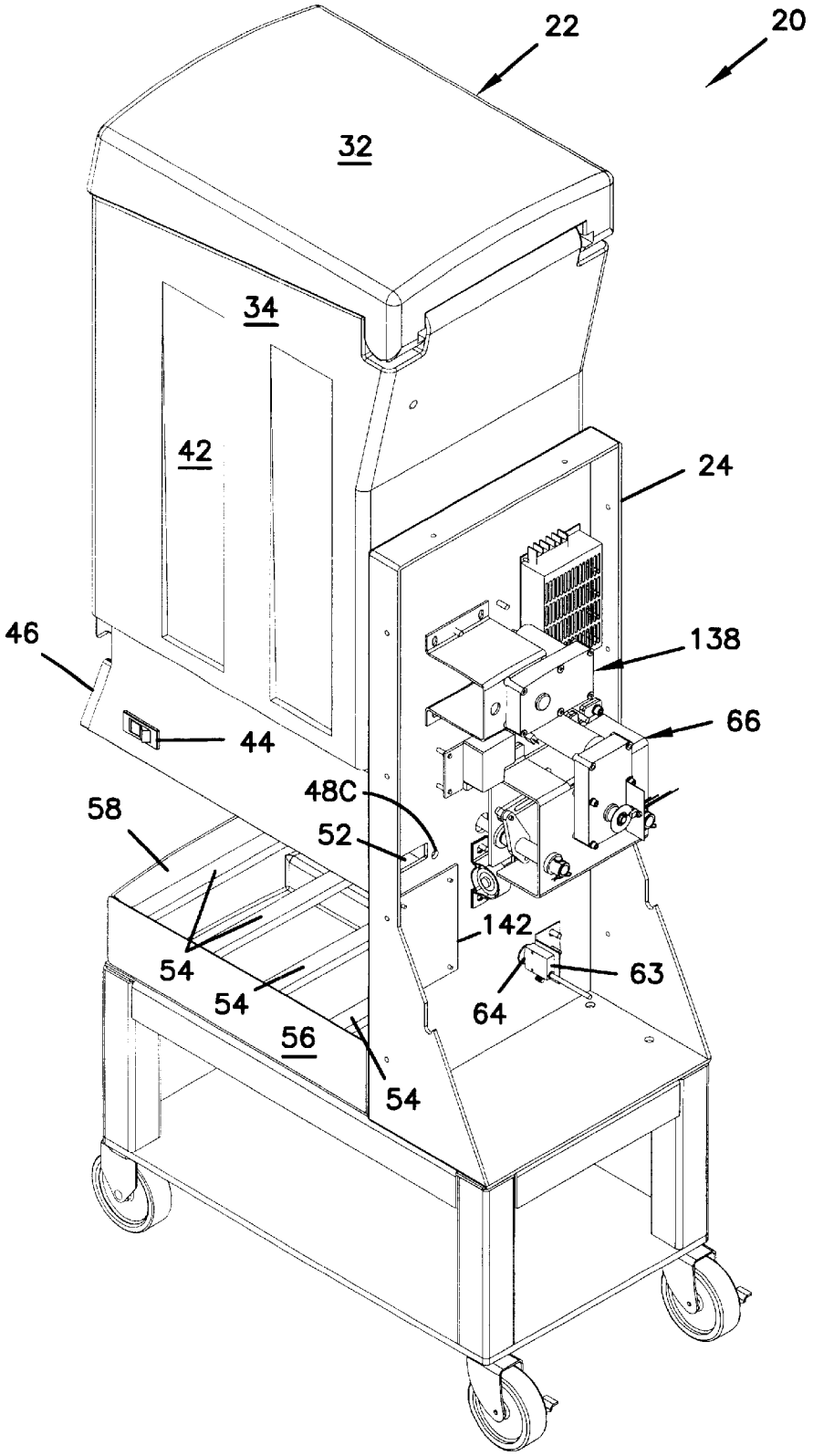
FIG. 1 is a perspective view of a dispenser, with a back side cover removed for illustration, of the present invention.
Figure 2:
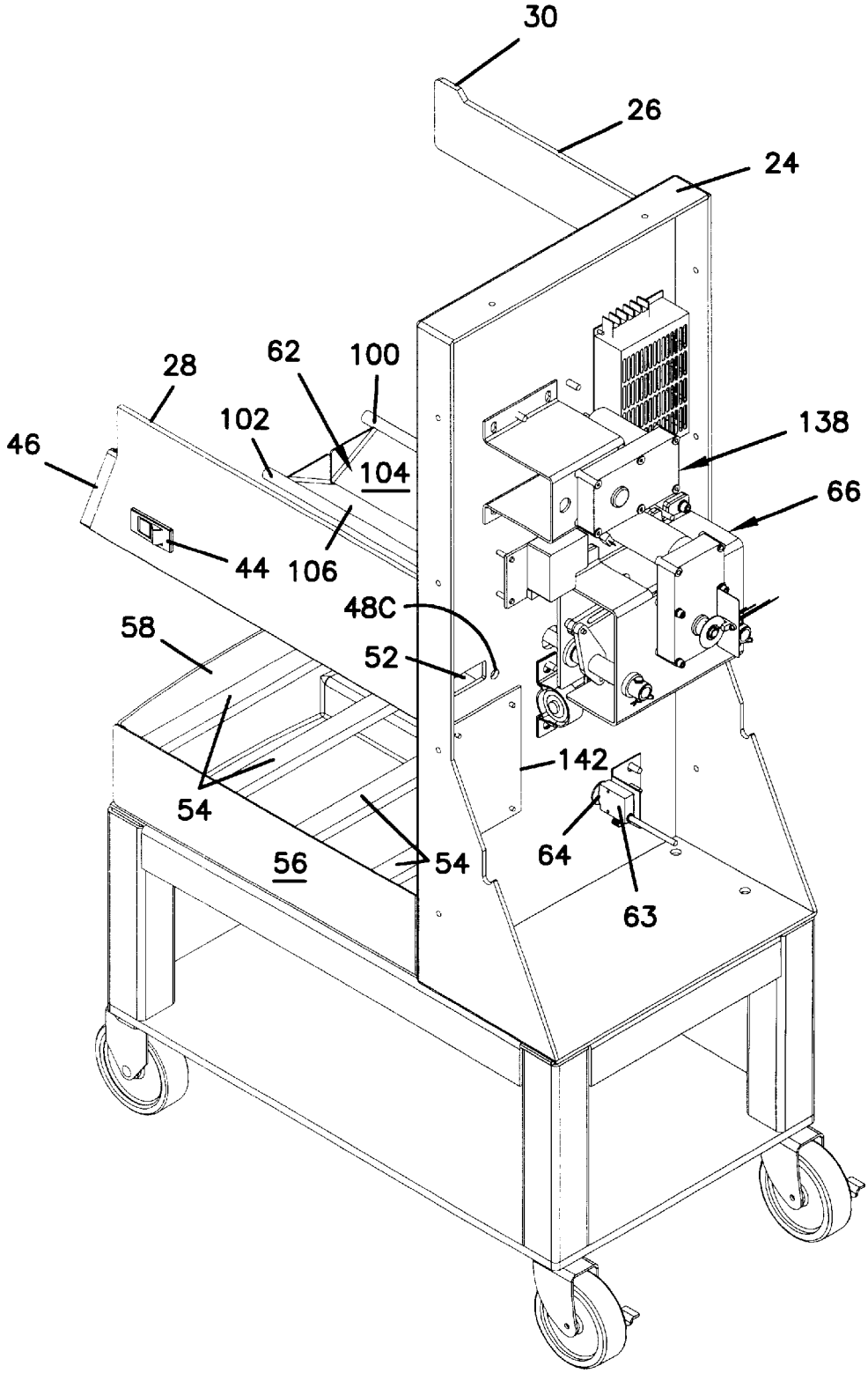
FIG. 2 is a perspective view of the dispenser of FIG. 1, with a hopper removed for illustration.
Figure 3:
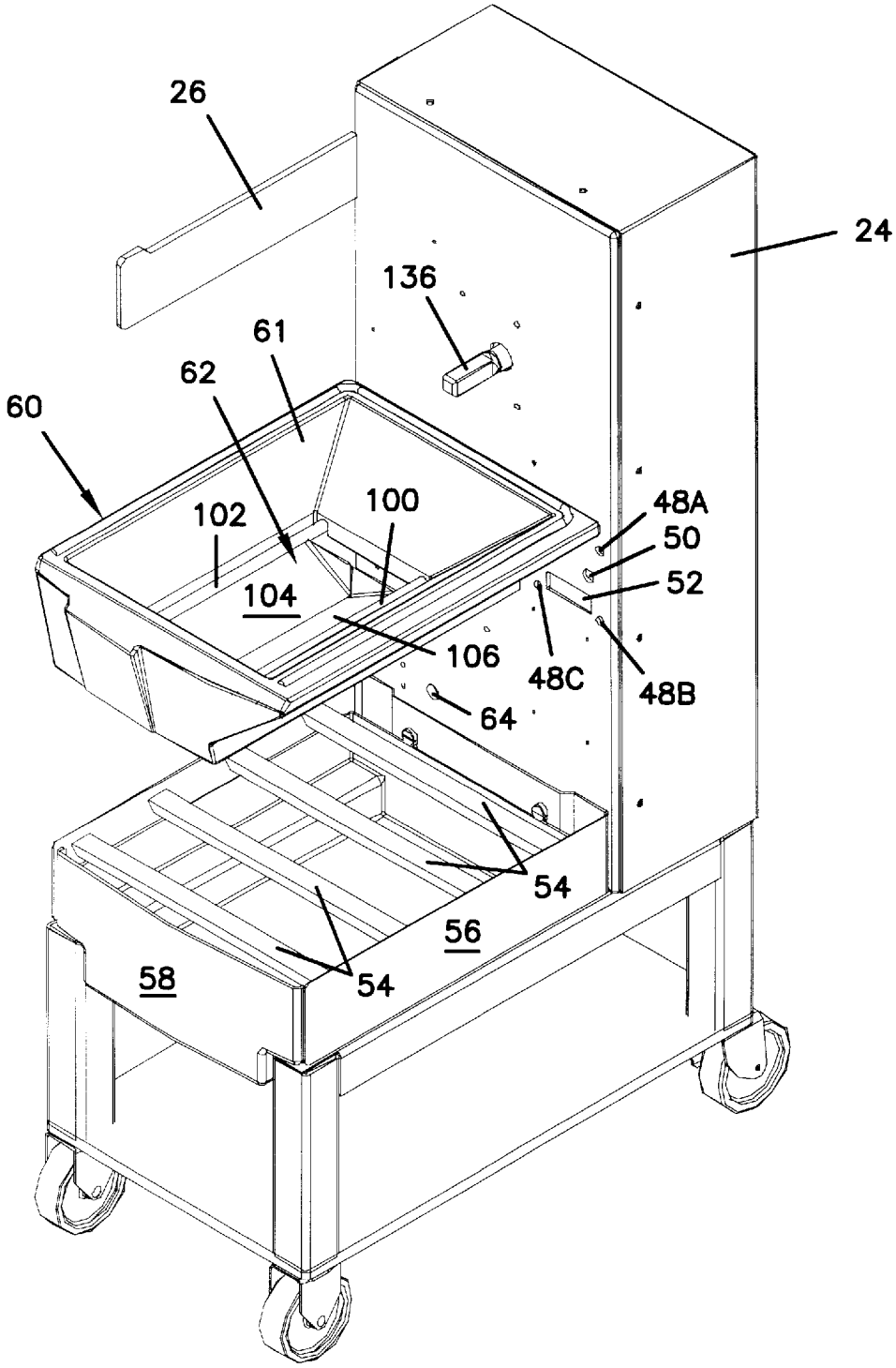
FIG. 3 is another perspective view of the dispenser of FIG. 2.

Turning now to FIGS. 1–3, there is illustrated a preferred movable dispenser unit designated by the reference numeral 20. The dispenser 20 includes a plastic molded hopper 22 which is mounted onto a housing or a frame 24 via extension members 26.28. The extension members 26,28 slidably fit through integrally formed grooves (not shown) at the bottom or side of the hopper 22. The extension member 26 has a shoulder section 30 at one end to retain the hopper 22 in place. It will be appreciated that other arrangements to support the hopper 22 can be used within the scope of the invention. For example, the extension member 28 can be replaced by another extension member 26 which is disposed at the opposite side of the extension member 26 as now shown in FIG. 2.

Figure 4:
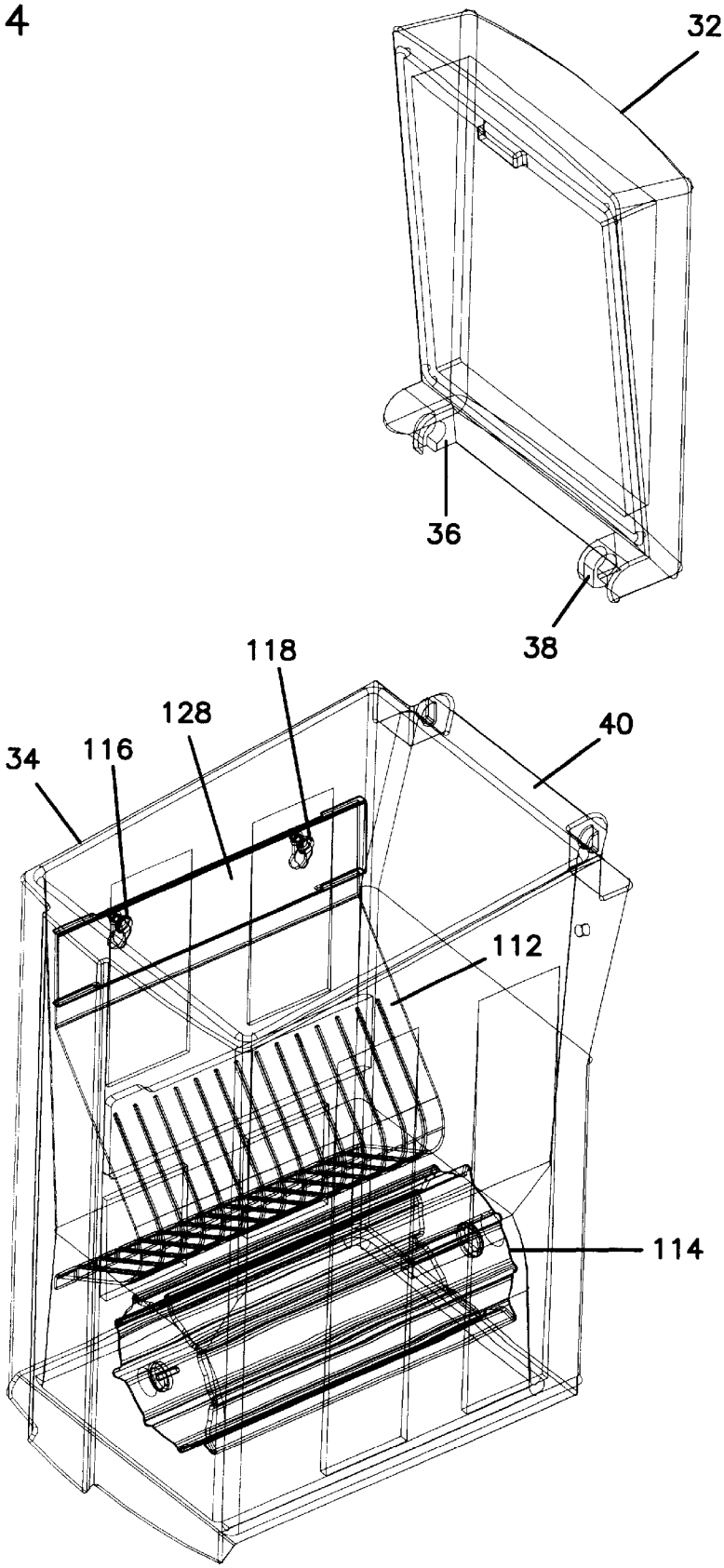
FIG. 4 is a perspective view of one embodiment of the hopper, with a hopper lid being detached, which encloses a dispensing drum and a diverter.
Figure 6A:
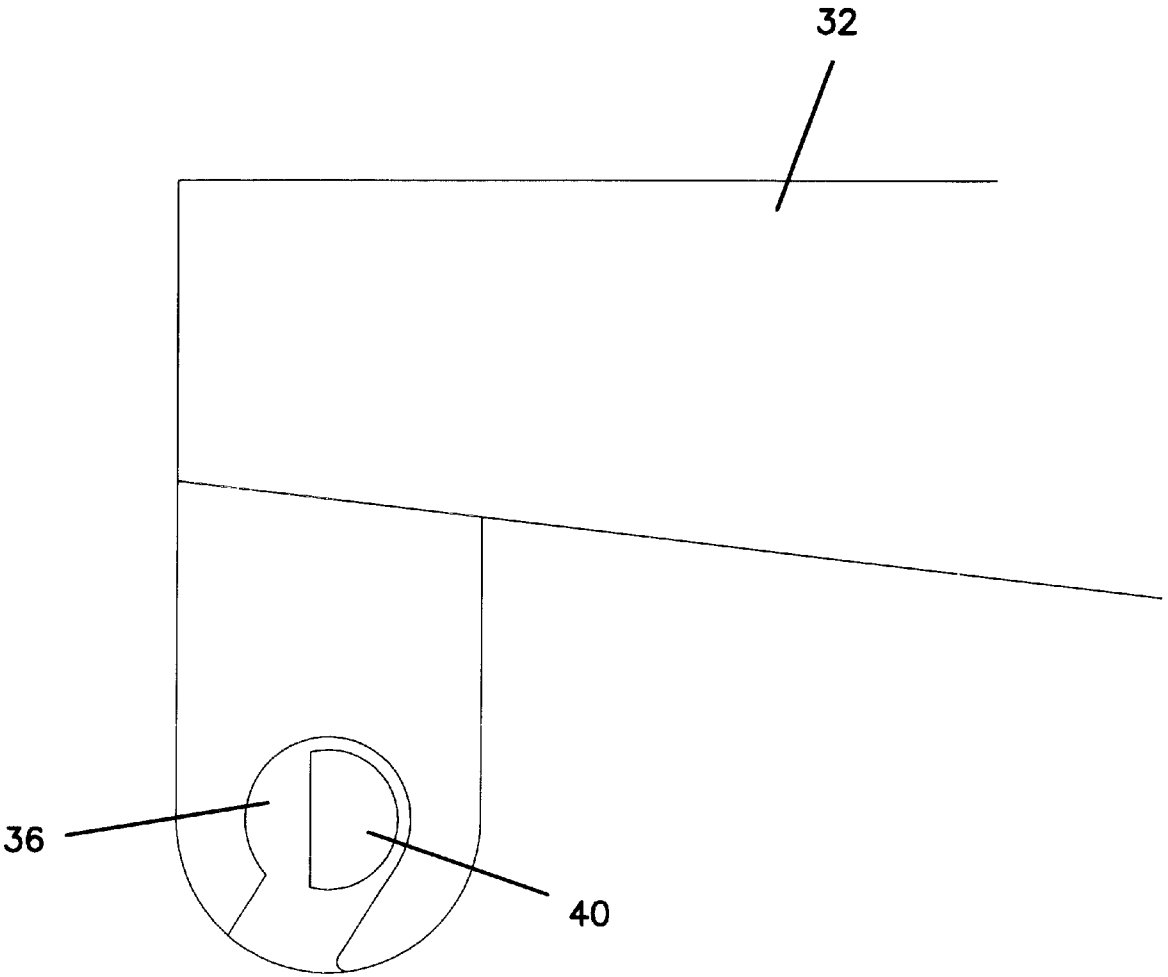
FIG. 6A is a schematic view of the hopper lid being in a closed position.
Figure 6B:
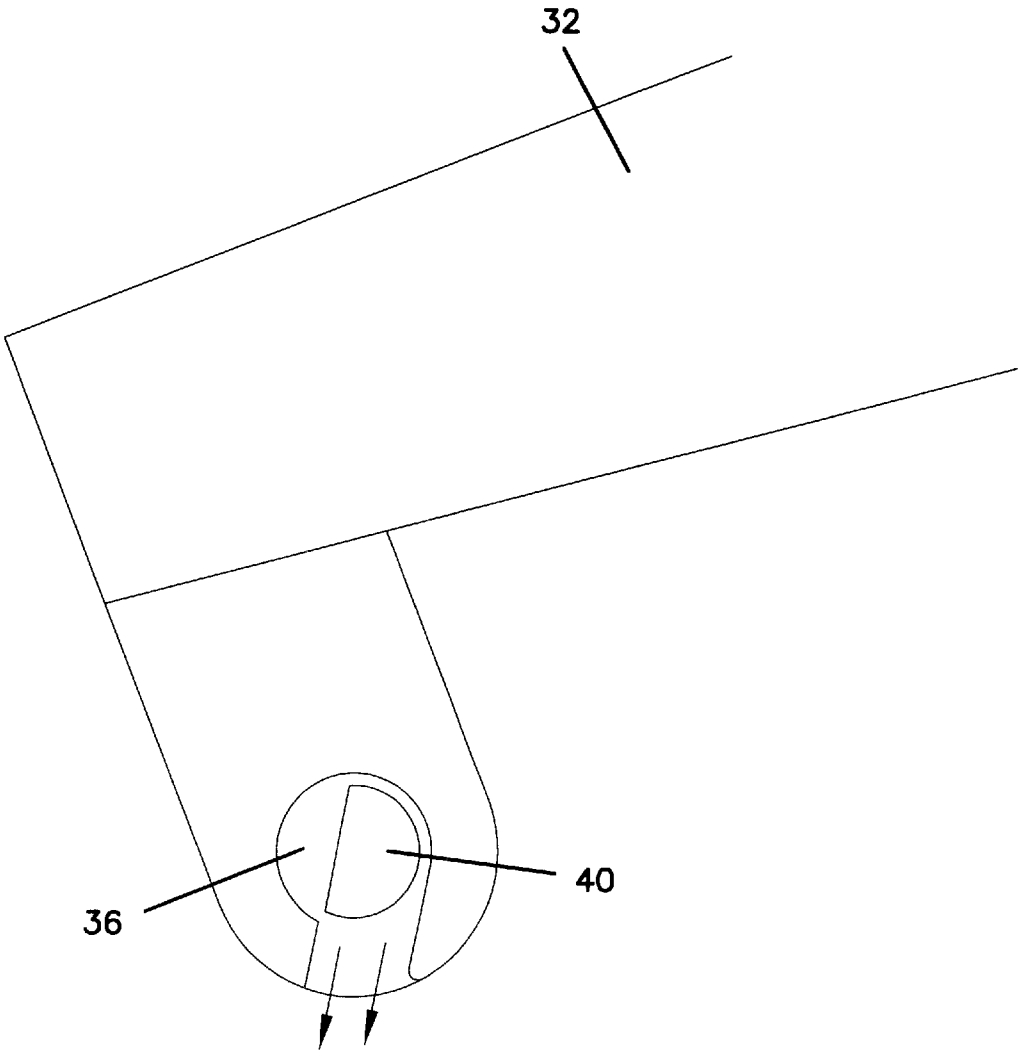
FIG. 6B is a schematic view of the hopper lid being in a removal position.
Figure 6C:
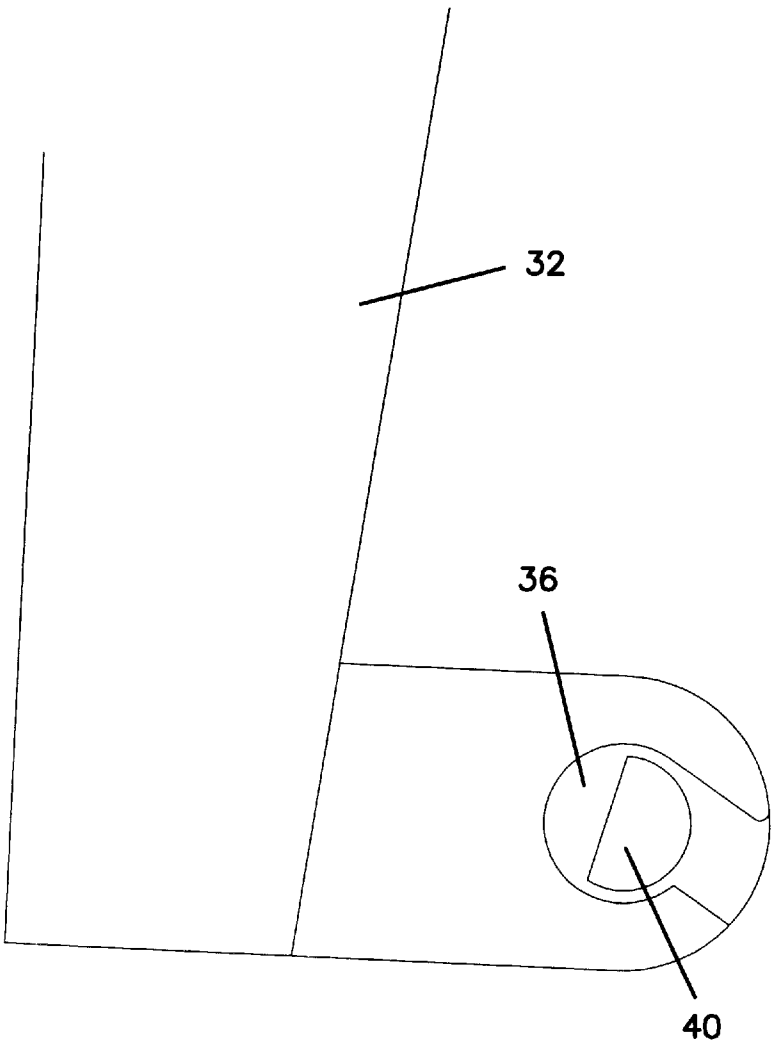
FIG. 6C is a schematic view of the hopper lid being in an open position.

The hopper 22 also includes a removable lid 32. Preferably, the hopper 22, when loaded with articles, is covered with the lid 32 to slow the defrosting/thawing of the frozen articles. The lid 32 is mounted onto a hopper body 34 at one edge as shown in FIGS. 1 and 4. The hopper lid 32 has a pair of curve-shaped notches 36,38 to receive a D-shaped rod member 40 which is extended from the hopper body 34. FIGS. 6A–C illustrate three positions that the hopper lid 32 may be placed. FIG. 6A shows that the hopper lid 32 is in a closed position, whereby the D-shaped rod member 40 is disposed approximately vertical to the lid 32, and the curve-shaped notch 36 is not aligned with the D-shaped rod member 40 so that the lid 32 may not be removed. FIG. 6B shows that the hopper lid 32 is in a removal position, for example, 30° degrees from the closed position, whereby the D-shaped rod member 40 is aligned with the curved-shaped notch 36 so that the lid 32 can be removed. FIG. 6C shows that the hopper lid 32 is in an open position, for example, 90° degrees from the closed position, whereby the D-shaped rod member 40 is approximately parallel to the lid 32. It will be appreciated that the angles can be varied according to the user's desire. In the open position, the lid 32 may still not be aligned with the curved-shaped notch 36 so that the lid 32 cannot be removed. It will be appreciated that the removal position can be changed within the scope of the present invention. For example, the lid 32 may be removed at the open position. The orientation of the curve of the notches 36,38 and/or the orientation of the D of the rod member 40 can be varied within the scope of the invention. In a preferred embodiment, the lid 32 is moved at a degree smaller than 90° degree, such as 30°, because in some instances, there may be an obstacle above the lid 32. Accordingly, the lid does not have to be opened all the way to be removed. The lid can be removed at an angle, such as 30°, without hitting the obstacle.

Back in FIGS. 1–3, the walls of the hopper 22 may also include a plurality of ribs 42 integrally formed therein to provide additional strength and/or for aesthetic purposes.

A control switch 44 may be mounted on the extension member 28 to turn on the dispenser unit 20. Also, a display 46 may be mounted on the frame 24 via through holes 48*a–c* to monitor the dispensing process. Electrical wires can be hidden at the back of the frame 24 via through hole 50 and/or a larger area 52.

Figure 12:
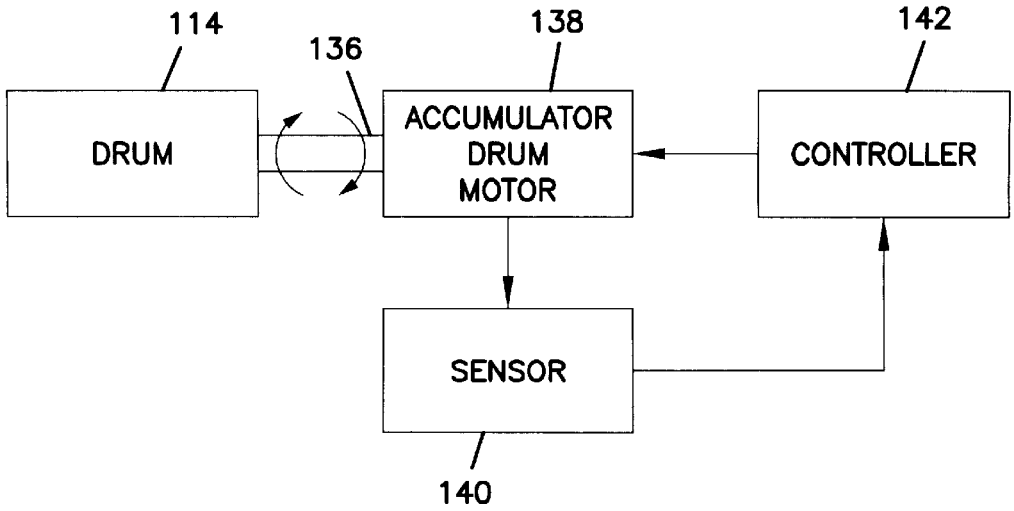
FIG. 12 is a functional block diagram of the reversible dispensing drum and its control means.

A basket (not shown) can be placed on a plurality of bars 54 of a tray holder 56. The tray holder 56 may be mounted on the frame 24. A tray 58 can slide in and out of the tray holder 56 like a drawer construction. The tray 58 is arranged and configured to receive the spilled or fallen articles outside of the basket. When the articles are dispensed from an accumulator 60, the basket should be placed underneath an accumulator door 62. A sensor 63 can be mounted onto the frame 24 via a through hole 64 to detect the presence of the basket. Once the sensor senses that a basket is present, the sensor sends a signal to a controller 142 (best seen in FIG. 12), e.g. a microprocessor known in the art. The articles can then be dispensed upon request. It will be appreciated that other sensor mechanisms can be implemented to sense whether the basket is empty without departure from the principles of the present invention. In addition, a basket location indicator can be arranged and configured on the tray holder 56. For example, an edge(s) of the tray holder 56 extends toward the side(s) of the basket to ensure that when the basket contacts the edge(s), the basket is directly underneath the accumulator door 62.

Figure 13A:
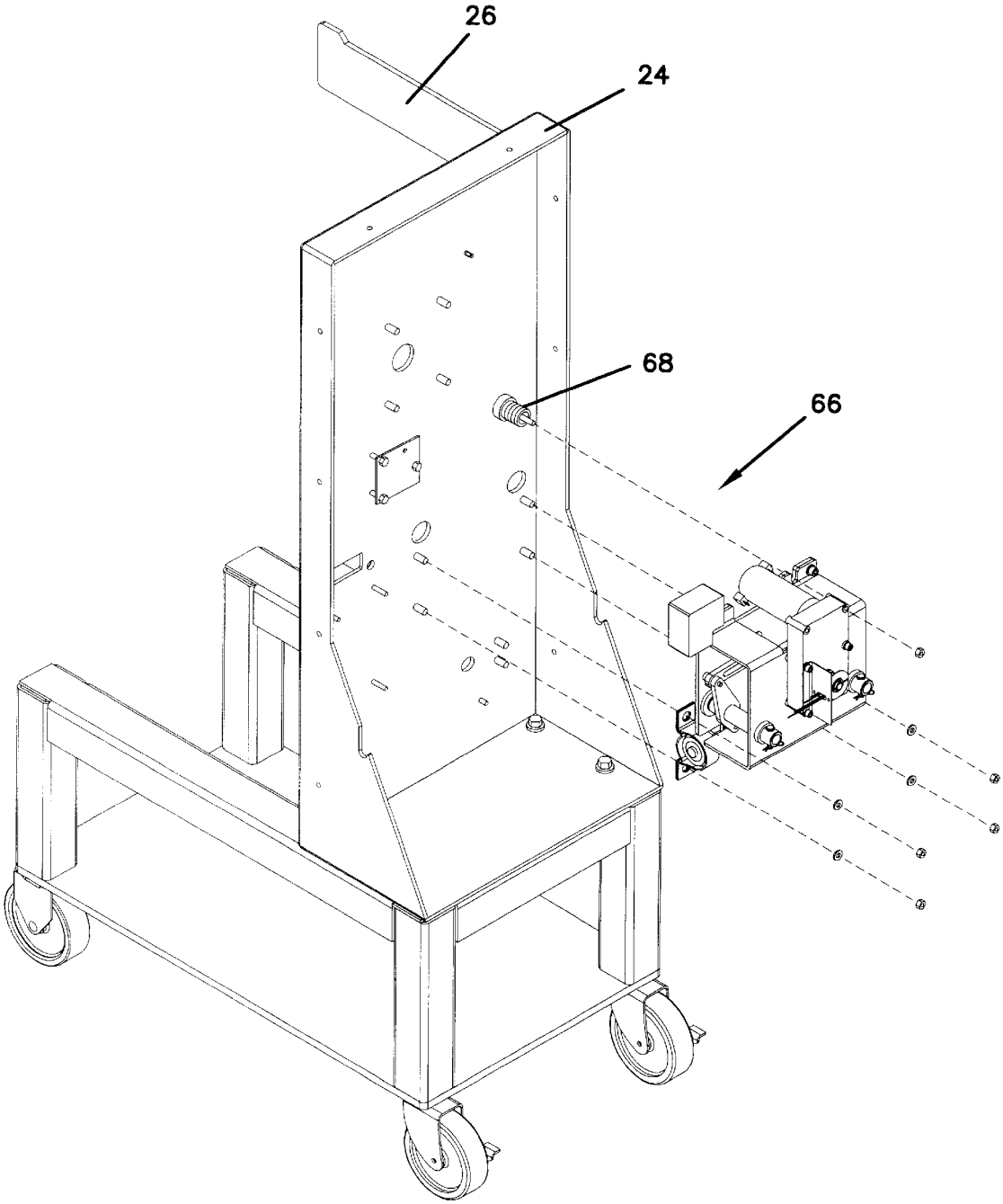
FIG. 13A is a partial exploded view of one embodiment of a load/weight sensing/measuring assembly.
Figure 13B:
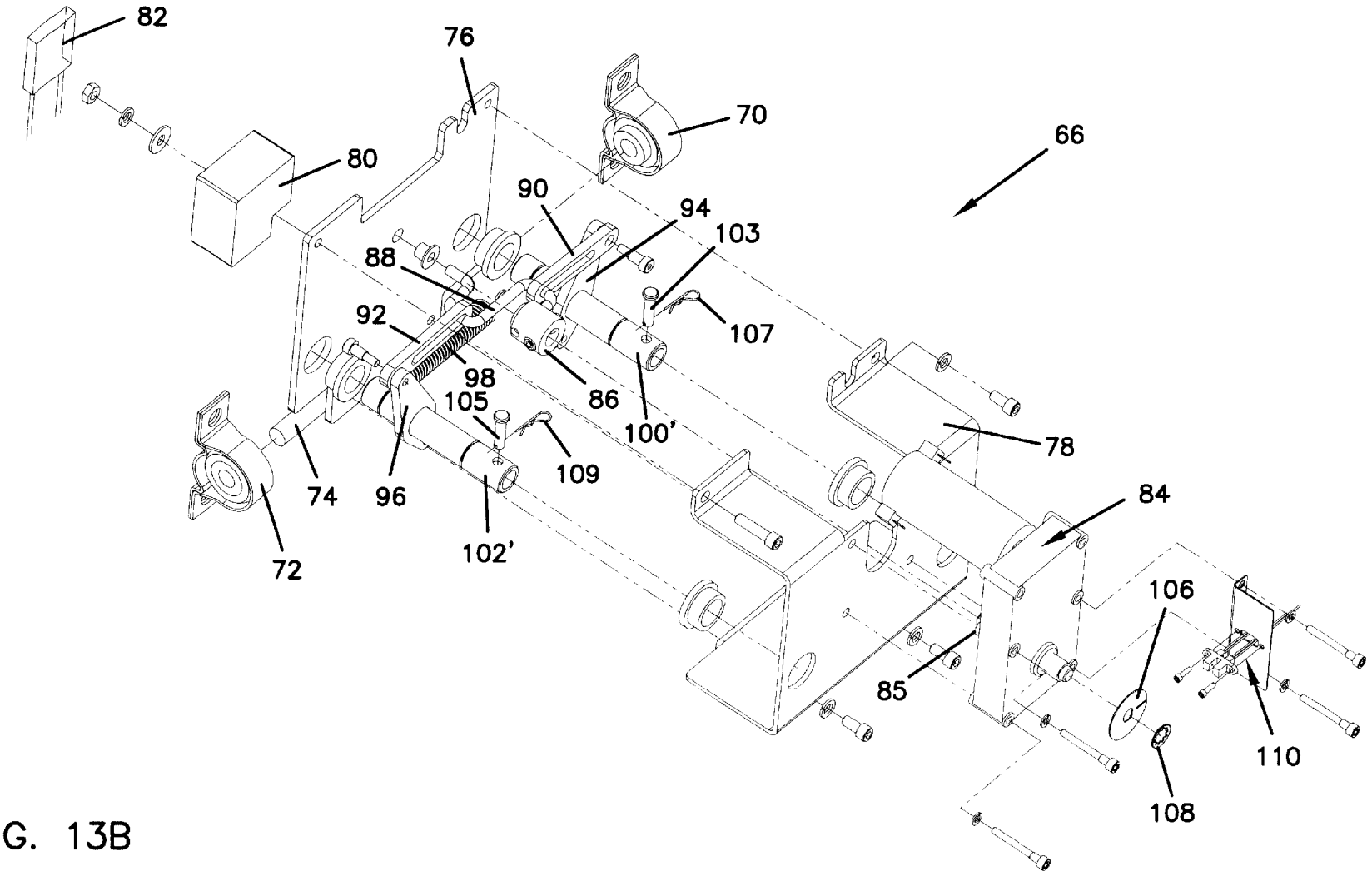
FIG. 13B is an exploded view of the embodiment of the load/weight sensing/measuring/dispensing assembly shown in FIG. 13A.

As shown in FIG. 3, the accumulator 60 is mounted onto the frame 24 and is separate from the hopper 22 to ensure accurate measurement of weight of the articles stored in the accumulator 60. The area between the bottom end of the hopper 22 and the accumulator 60 is the accumulator article storage area 61. The stored articles are held by the accumulator door 62 until a target weight of the articles is reached. The weight of the articles is monitored by a load/weight sensing/measuring assembly 66 as illustrated on the back side of the frame 24. FIGS. 13A–B illustrate the parts and components of a preferred embodiment of the load/weight sensing/measuring assembly 66. A compression spring 68 is mounted on the frame 24. The spring 68 has its predetermined length and is compressed to different lengths when different weights of the articles are measured. The load/weight sensing/measuring assembly 66 is pivotable around a pivotal bearing assembly, such as a pair of pivotal bearings 70,72 as shown in FIG. 13B. The bearings 70,72 are connected to a pivotal rod 74, and the assembly 66 is pivoted about the axis of the rod 74. The rod 74 is connected to an assembly plate 76 at the bottom end of the assembly 66. A magnet (not shown) is retained in a magnet enclosure 80 which is connected to the assembly plate 76 on one side. On the other side of the enclosure 80, a sensor 82 (preferably a magnetic sensor), a distance apart from the magnet, is mounted on the frame 24. When there is no article in the accumulator storage area 61, the distance between the sensor 82 and the magnet is predetermined (a home position). When the articles are accumulated in the area 61. the load/weight sensing/measuring assembly 60 pivots thus compresses the spring 68 while shortening the distance between the sensor 82 and the magnet in the enclosure 80. The sensor 82 in turn sends a weighed signal to the controller 142 (best seen in FIGS. 12, 14, and 15) which determines whether a target weight for dispensing is reached. Based on the weighed signal and the predetermined parameters, the controller 142 sends a control signal to a drum motor 138. The activation/deactivation and the rotation speed of the drum motor 138 are controlled by the controller. Once the desired weight is reached, the controller 142 then determines whether a user dispensing request or an automatic dispensing request is made. If the request is made, the controller sends a control signal to an accumulator motor 84 to open the accumulator door 62.

Figure 14:
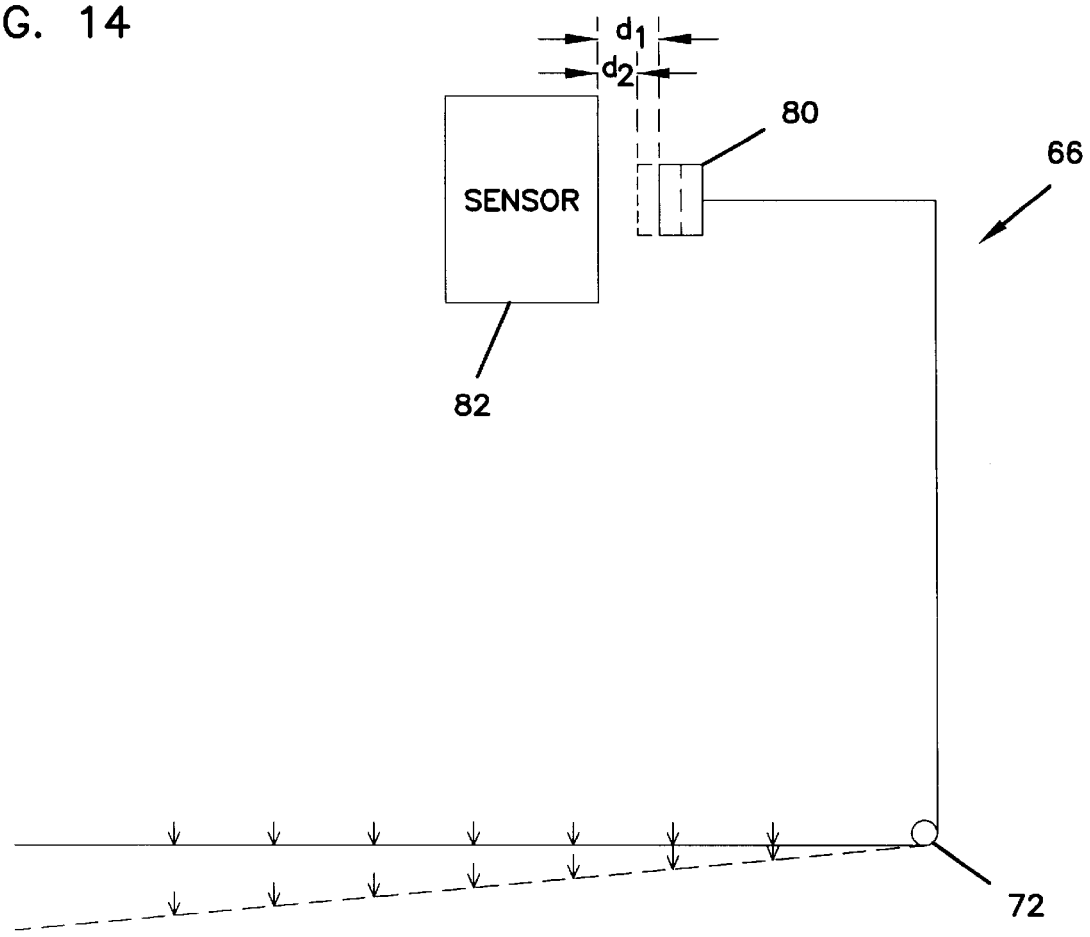
FIG. 14 is a schematic view of the load/weight sensing/measuring assembly.
Figure 15:
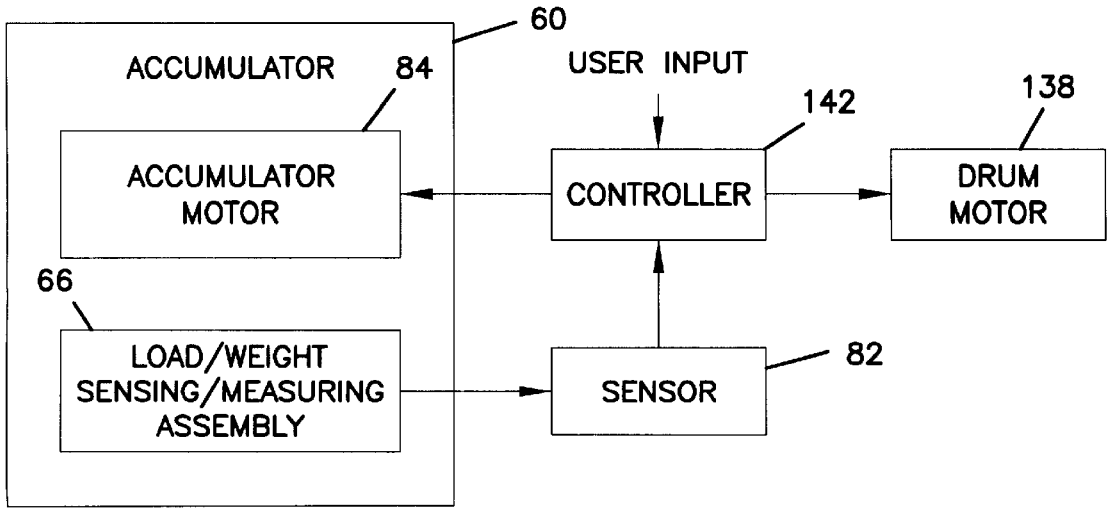
FIG. 15 is a functional block diagram of the load/weight sensing/measuring assembly.

For better illustration and understanding, a schematic view of the load/weight sensing/measuring assembly 66 is shown in FIG. 14, a functional block diagram of the load/weight sensing/measuring assembly 66, the control means, and the accumulator door 62 is shown in FIG. 15.

Further, the sensor 82 may also sense the distance after dispensing. In some cases, particles of the articles may stick on the accumulator 60 after dispensing which may cause inaccuracy of the weight measurement for the next dispensing cycle. The sensor 82 sends a correction signal to the controller so as to adjust a "zero" weight.

Figure 16:
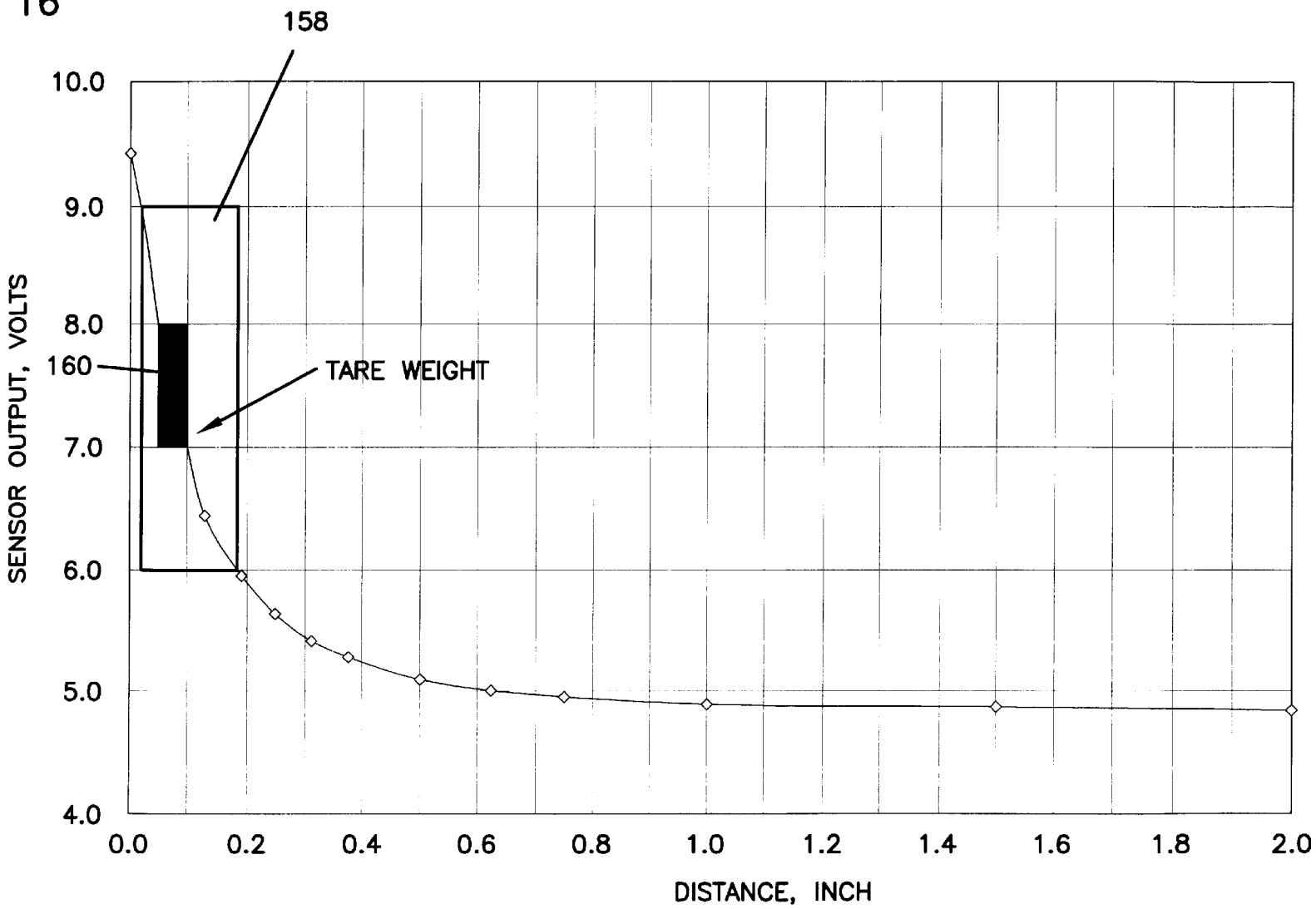
FIG. 16 is a schematic diagram of a load sensor output based on a distance between a magnet to a sensor.

FIG. 16 illustrates a schematic diagram of the input/output of the sensing/weighing mechanism between the sensor 82 and the magnet. The horizontal axis represents the distance, e.g. d1,d2 (in FIG. 14), between the magnet and the sensor 82. The vertical axis represents the output of the sensor 82. The envelop 158 is a sensor operation envelop of the sensor 82. The darkened window 160 is an actual weighing window of the assembly 66. It can be seen from FIG. 17 that the actual weighing window 160 can be adjusted within the sensor operation envelop 158 according to the different "zero" weight (or called "tare weight") adjustment.

Figure 17:
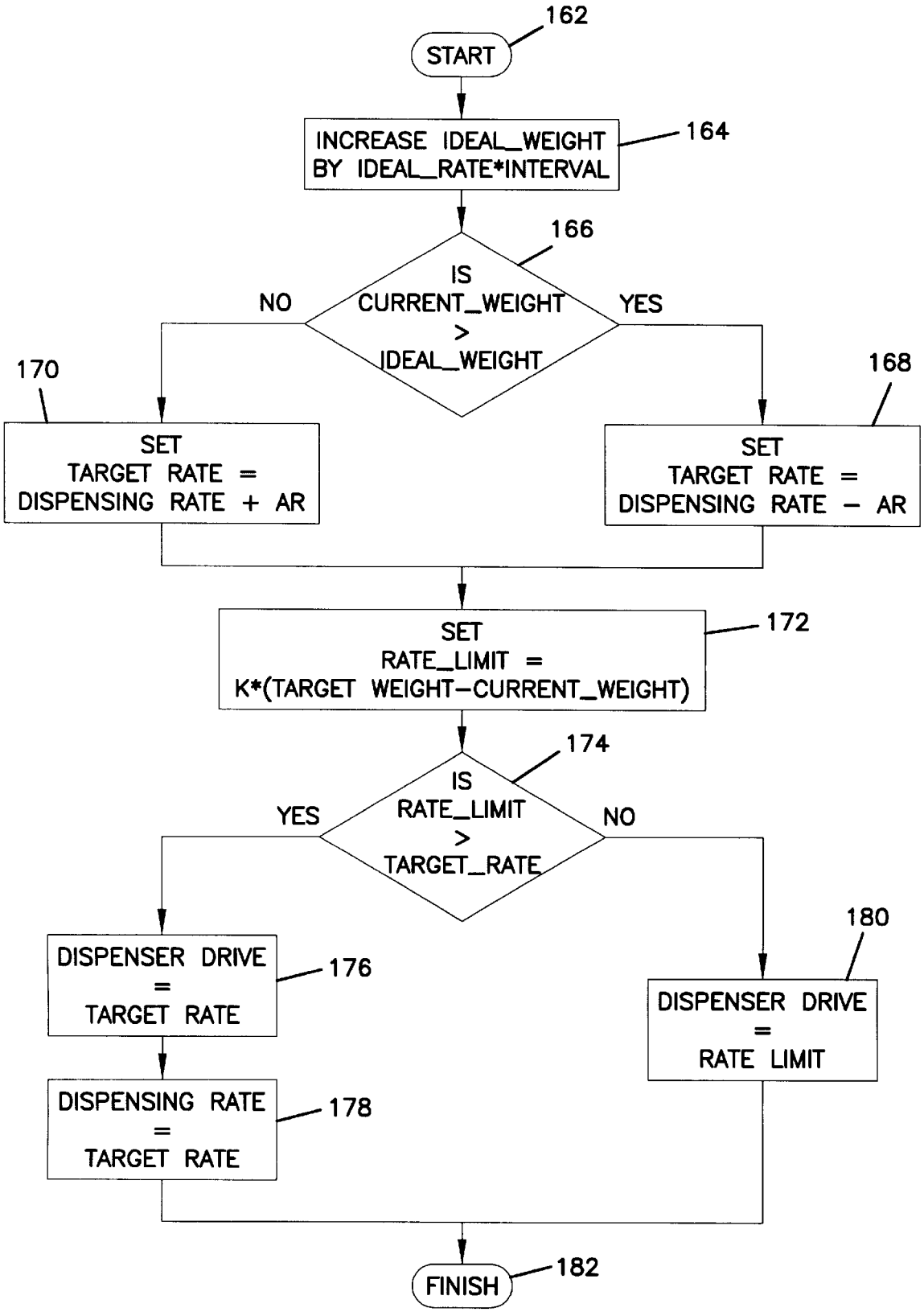
FIG. 17 is a functional flow chart of an adaptive weighing operation of the present invention.

FIG. 17 illustrates a functional flow chart of an adaptive weighing operation of the present invention. This adaptive weighing method can be implemented in the controller 142 during the weighing/measuring process of the articles in the accumulator 60 so as to dispense the articles in an efficient and intelligent manner. Preferably, an adaptive weighing operation reacts to the approaching target weight and determines an appropriate dispensing rate, e.g. reduces the dispensing rate, etc. The adaptive weighing method optimizes the dispensing rate by adjusting its dispensing rate to match a predetermined rate. The controller monitors in real time the sensed weight signal from the sensor 82 and operates the drum motor 138 to control the articles dispensed into the accumulator area 61 to a predetermined level. Furthermore, by monitoring the movement of the drum 114 and the weight of the transferred articles in the accumulator 60, the controller 142 learns the characteristics and parameters of the dispensing cycle and in turn determines the manner in which the drum 114 should be operated in a future dispensing cycle. Accordingly, the adaptive weighing method not only improves the accuracy and efficiency of the dispensing rate, but also provides an intelligent dispensing process.

In FIG. 17. the adaptive weighing operation starts in box 162. A parameter, Ideal_Weight, is increased by a parameter, Ideal_Rate, times a parameter, Interval in box 164. The parameters, Ideal_Weight, Ideal_Rate, and Interval, have predetermined values. Next. the controller 142 compares the measured current weight of the articles held by the accumulator door 62 to the Ideal_Weight in box 166. If the current weight is greater than the Ideal_Weight (i.e. the "yes" path), the controller sets a target rate (a parameter for determining the dispensing rate which transforms to a control signal to the motor 138) to be the current dispensing rate minus Ar in box 168. In this situation, the current weight may approach to the target weight. If the current weight is not greater than the Ideal_Weight (i.e. the "no" path), the controller sets the target rate to be the current dispensing rate plus Ar, in box 170. In this situation, the current weight may not have approached to the target weight. The value Ar can be a predetermined constant or a value proportional to or approximately proportional to the difference between the ideal weight and the actual weight. It will be appreciated that the value Ar can be adjusted within the scope and spirit of the invention. For example, it can be adjusted depending on the type of product etc.

The controller 142 then sets a parameter, Rate_Limit, to be a product of a constant, k, and the difference between the target weight and the current weight in box 172. Next in box 174, the controller compares the Rate_Limit calculated in box 174 to the target rate set in either box 168 or 170. If the Rate_Limit is greater than the target rate (i.e. the "yes" path), the target rate is then used as a dispensing rate for farther dispensing, i.e. the dispenser motor 138 is driven by the target rate in box 176, and the dispensing rate continues to be updated to the new target rate in box 178. If the Rate_Limit is not greater than the target rate (i.e. the "no" path), the Rate_Limit is then used as a dispensing rate for further dispensing, i.e. the dispenser motor 138 is driven by the Rate_Limit in box 180. Thereafter, one cycle of the adaptive weighing operation finishes in box 182.

Accordingly, the dispensing rate is only updated if it is less than the Rate_Limit. When the target rate is greater than the Rate_Limit, it indicates that the dispenser is close enough to the target weight that it should begin slowing down to stop the motor. Also, when weighing is complete, the dispenser may compare the initial and final values for the dispensing rate. In this manner, when the dispenser is confronted with a new product, it can adjust itself such that it begins with an optimum weighing speed, and over a period of time, e.g. after several dispensing cycles of the new product, the controller learns the characteristics and parameters of the new product and is able to adjust itself to fit for the new product. Further, in a similar manner, the controller can adjust itself in real time to gradual changes in the product, such as thawing.

Figure 9:
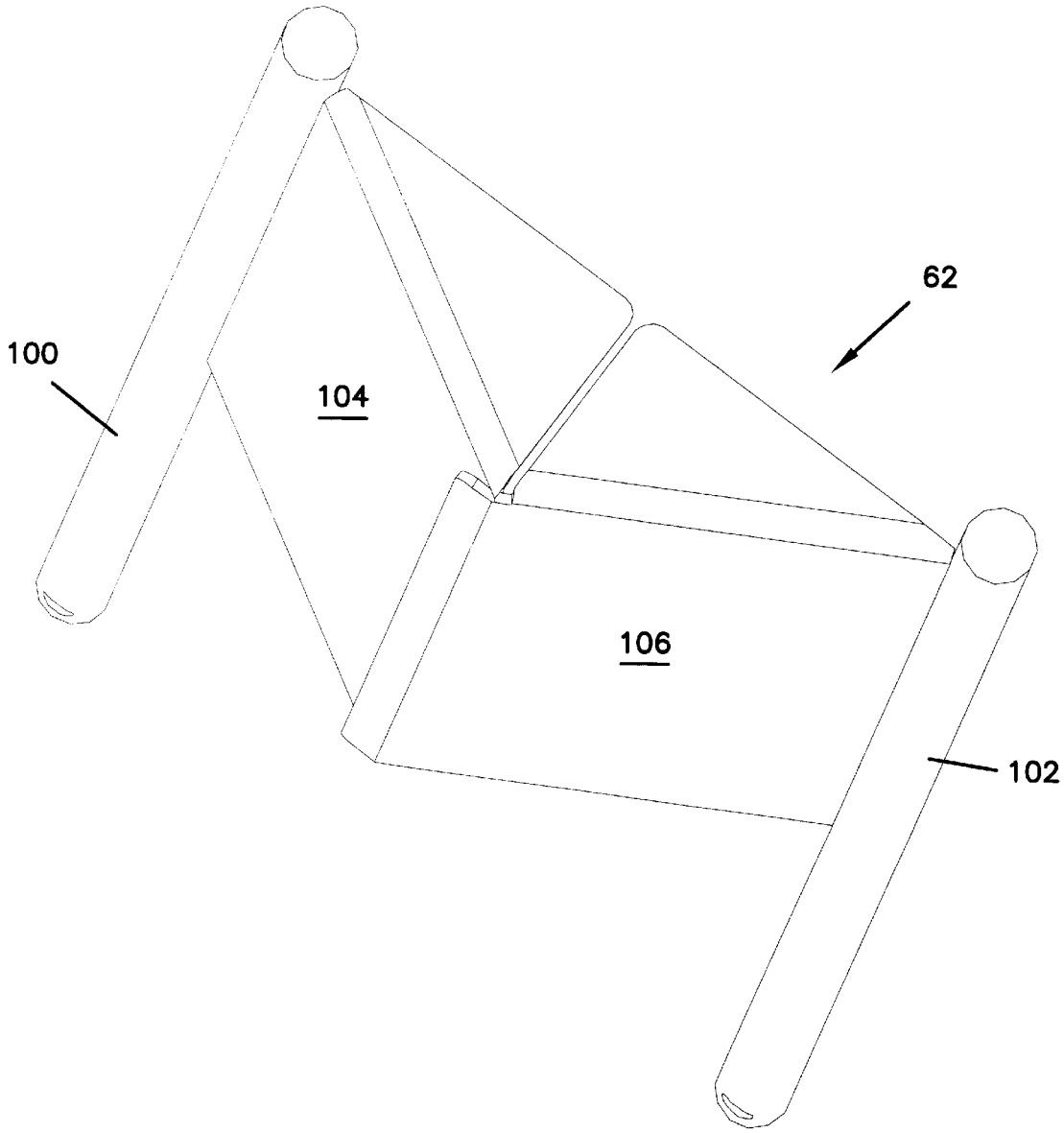
FIG. 9 is a perspective view of one embodiment of an accumulator door.

As shown in FIG. 13B, the accumulator motor 84 is mounted on a housing 78 which is in turn mounted onto the plate 76. The motor 84 can be a conventional DC motor known in the motor art. A motor shaft 85 is retained in a drive member 86. The drive member 86 is connected to a center link 88. The center link 88 has two U-shapes, each one of which is connected to a side link 90,92, respectively. Each of the side links 90.92 is pivotally jointed with a connecting member 94,96, respectively. A spring 98 is disposed between one end of the connecting member 94 and one end of the connecting member 96. In addition, each of the connecting members 94,96 is mounted onto an accumulator door arm 100, 102 (see FIG. 9) via a connecting tube 100',102', respectively. The connecting tubes 100',102' extend at a first end through the plate 76 and at a second end through the housing 78. The door arms 100,102 are retained in the connecting tubes 100',102' by mounting pins 103,105 and retaining springs 107,109. As shown in FIG. 9, at the first end of each of the door arms 100,102, a piece of door flap 104,106 is connected to each door arm 100,102, respectively. The door arms 100,102 and the door flaps 104,106 form the accumulator door 62 shown in FIGS. 2 and 3.

Back in FIG. 13B, the spring 98 is normally biased such that the accumulator door 62 is normally closed. When the controller 142 signals to open the accumulator door 62, the motor shaft 85 of the accumulator motor 84 drives the member 86 which in turn cranks the center link 88 in one direction which alternately brings the side link 90 close to the side link 92 and brings the side link 92 close to the side link 90. Accordingly, the side links 90,92 bring the top end of the connecting member 94/100',96/102' close to each other, whereby the arms 100,102 rotate toward each other which opens the door flaps 104,106. Meanwhile, the spring 98 is expanded. The articles in the area 61 are dispensed into the basket. The motor 84 runs for a predetermined period of time set in the controller. After the dispensing, the controller sends a control signal to the motor 84 to close the accumulator door 62. The motor 84 runs for a predetermined period of time set in the controller or until sensing a home position by a sensor 110. In the closing operation, the biased spring 98 assists the motor 84 to move the top of the connecting members 94,96 away from each other. The arms 100.102 are in turn rotated in their opposite directions, which close the accumulator door 62. The spring 98 also provides a safety feature when the door is closed to prevent pinch hazard which would be caused by a rigid member if it replaces the spring 98. The parts and components of the accumulator 60, except the accumulator door 62 and the ends of the arms 100,102, are disposed inside between the housing 78 and the plate 76.

Further as shown in FIG. 13B, the home position of the accumulator door is determined by the home position of the motor shaft 85 which is registered in a home registration vane 106. The home registration vane 106 is retained by a self locking ring 108. The sensor 110 is mounted on the accumulator motor 84 proximate the home registration vane 106. The sensor 110 is used to detect the home position of the motor shaft 85 via the vane 106. The sensed signal is sent to the controller 142 to signify the home position of the motor shaft so that the controller is informed the status of the motor 84 to determine whether the motor 84 should be stopped.

The accumulator door 62 is best seen in FIG. 9. The two door flaps 104,106 of the accumulator door 62 are arranged and configured to have one of the door flaps 106 extends over the other door flap 104 (or vice versa) at their connecting end to restrict air flow entering into or exiting out of the accumulator door 62. This accumulator door construction helps slow the defrosting/thawing of the frozen articles caused by air flow.

Mounting means of various parts and components which are shown in the drawings are preferably used in the present invention. It will be appreciated that other mounting or attaching means can be used without departure from the principles of the present invention.

Figure 5:
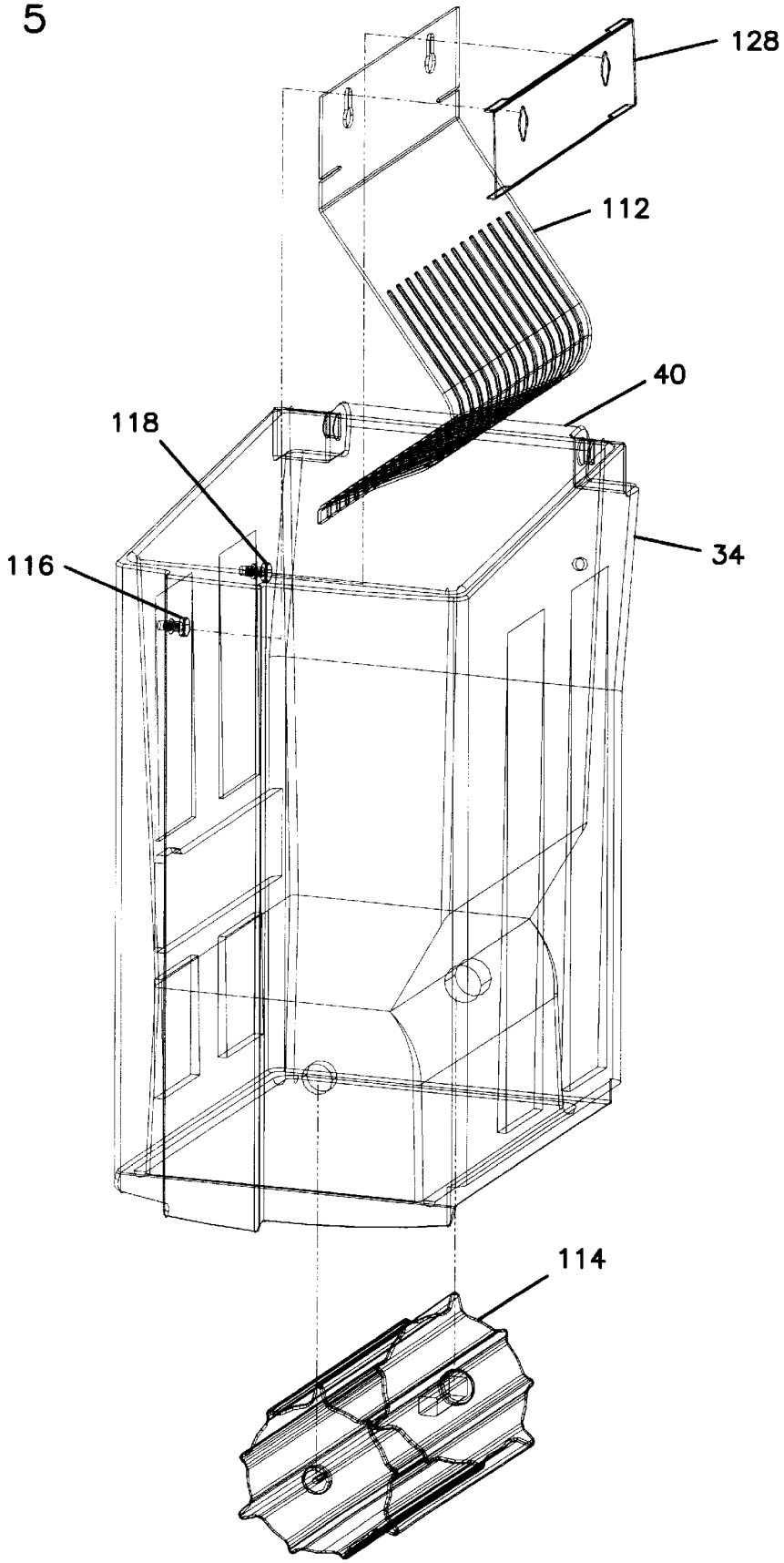
FIG. 5 is an exploded view of a hopper body, the dispensing drum, and the diverter of FIG. 4.

Back in FIGS. 4 and 5, the hopper body 34 contains a diverter 112 and a drum 114. The diverter 112 is detachably mounted on an inside wall of the hopper body 34. On the inside wall, there are two shoulder bolts 116,118. The heads of each shoulder bolts 116,118 extends through holes 120, 122 of the diverter 112 (best seen in FIG. 7). The through holes 120,122 are adjacent to slots 124.126, respectively. A locking plate 128 has two holes closer to one edge than the opposite edge of the plate 128. When the holes of the locking plate 128 are aligned with the shoulder bolts 116,118 and the through holes 120,122 of the diverter 112, the diverter 112 is locked in place on the inside wall the diverter 112. When the locking plate 128 with the two holes is placed closer to the upper end of the hopper 22, the diverter 112 is locked in place whereby the shoulder bolts 116,118 are disposed in the slots 124 126,. When the locking plate 128 with the two holes is placed farther from the upper end of the hopper 22, the diverter 112 is locked in place whereby the shoulder bolts 116.118 are disposed in the holes 120.122. Accordingly, the distance between the diverter 112 and the drum 114 can be adjusted by orienting the plate 128. This allows different sizes of articles to be dispensed, e.g. the larger sized articles such as onion rings or the smaller sized articles such as french fries.

Figure 7:
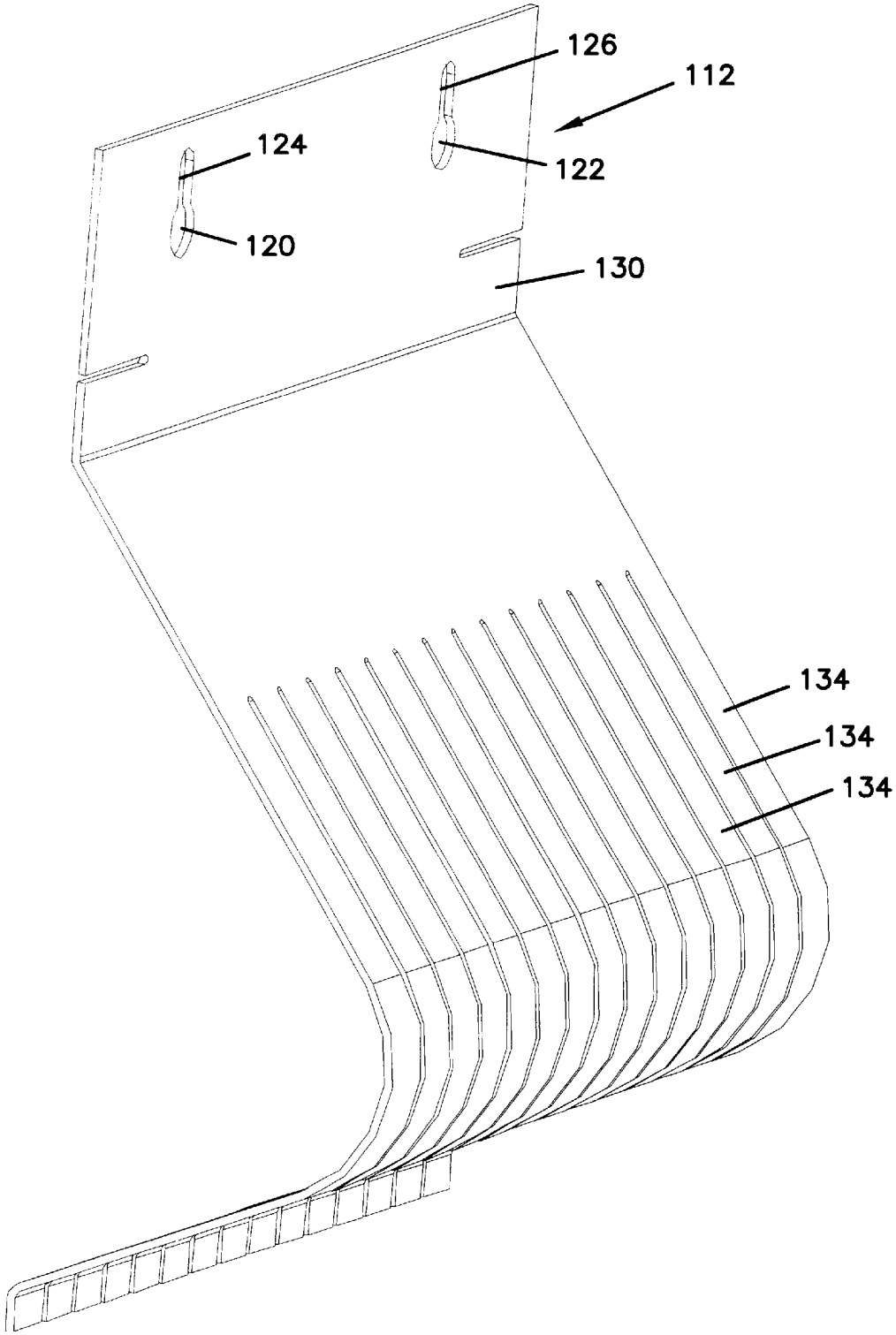
FIG. 7 is a perspective view of one embodiment of the diverter.

An enlarged view of the diverter 112 is shown in FIG. 7. The diverter 112 has a mounting section 130 and a flexible C-shaped section 132 with a plurality of prongs 134. Each of the prongs 134 is preferably resilient and made of plastic materials such as ABS plastic materials, etc. As a result, when a larger piece of article passes through the space between the prongs 134 and the drum 114, the corresponding prong(s) 134 is temporarily deformed to allow the larger piece of article to fall into the accumulator without breaking the piece. Since only the corresponding prong(s) 134 is deformed, the other prongs can still function as a diverter to control the amount of the articles to fall into the accumulator 60.

Figure 11:
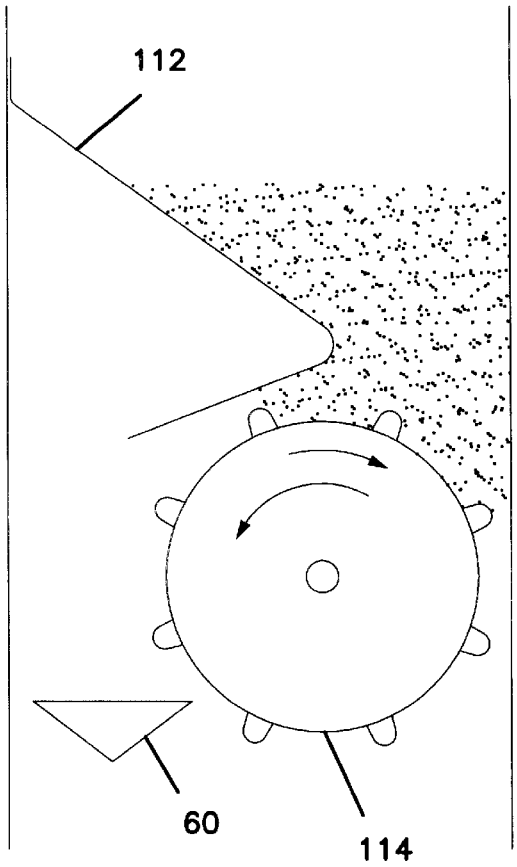
FIG. 11 is a schematic view of the reversible dispensing drum.

Further in FIGS. 4 and 5, the drum 114 is detachably mounted on a motor shaft 136 (best seen in FIG. 3) of the drum motor 138 (best seen in FIGS. 1 and 2). The drum motor 138 drives the drum 114 to move the articles toward the diverter (best seen in FIG. 11). The motor 138 can be any type of suitable motor known in the motor art which provides the control of the drum position and force imposed on the drum.

In addition, a sensor is arranged to sense the velocity (i.e. the rotation speed) of the drum and/or the current generated from the rotation of the motor. The sensed signal is then sent to the controller 142 which sends a control signal to control the rotation of the drum motor 138. When the rotation speed of the drum decreases and/or the current increases, there is an indication that a clog may occur between the drum 114 and the diverter 112. Upon receipt of the sensed signal by the controller 142, the controller sends a control signal to the motor 138 to reverse the motor for a predetermined time or turn. Then. the controller sends a control signal to further rotate the motor in a normal direction. For better illustration and understanding, a functional block diagram of the reversible drum and the control means is shown in FIG. 19.

Further, as shown in FIGS. 1–2. the drum motor 138 is mounted onto the frame 24. The motor shaft 136 passes through the frame 24 to connect to the drum 114. The reversing drum assembly significantly reduces the article (e.g. french fries) breakage during their transfer from the hopper 22 to the accumulator 60.

Figure 8A:
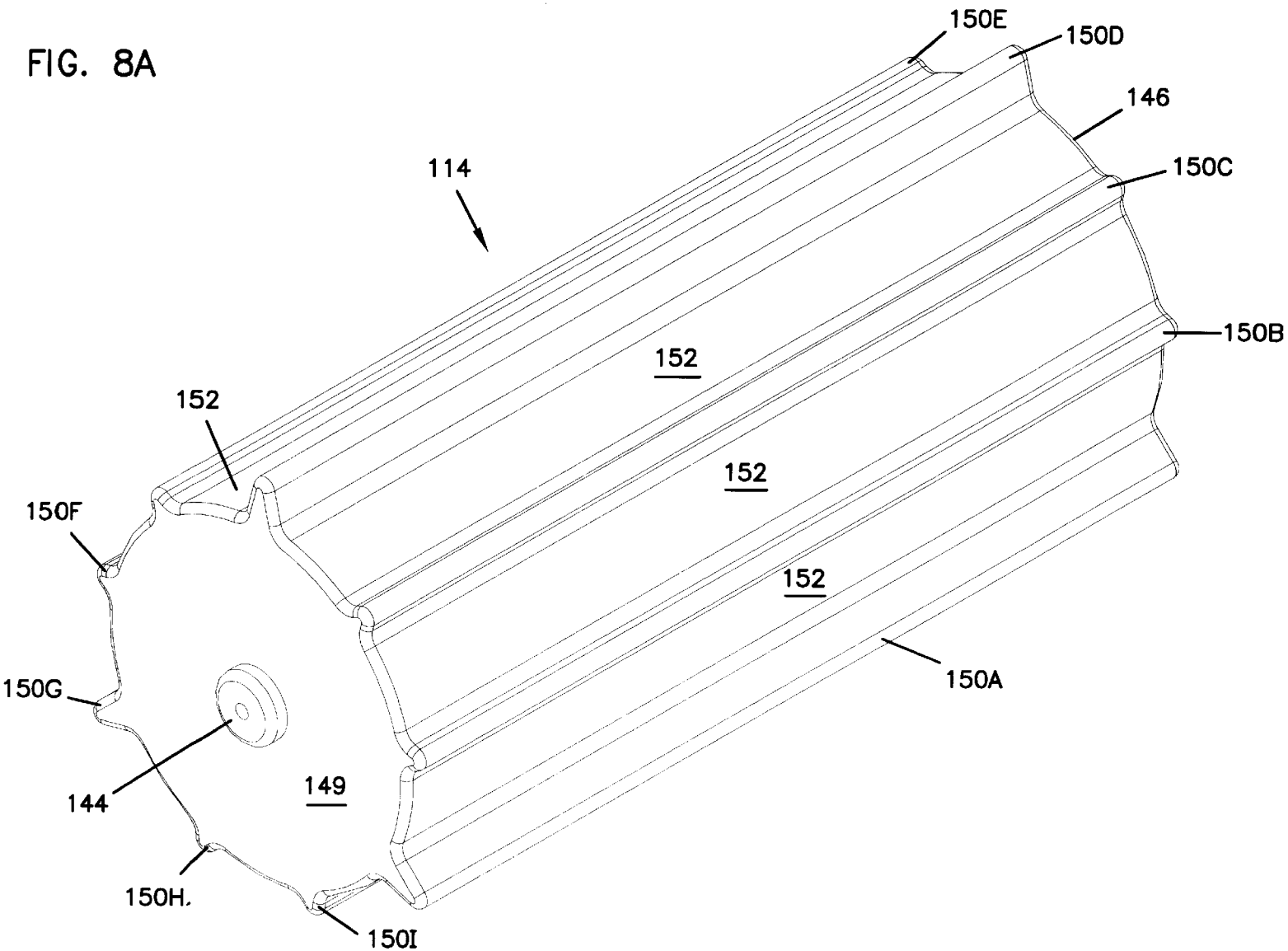
FIG. 8A is a perspective view of one embodiment of the dispensing drum.
Figure 8B:
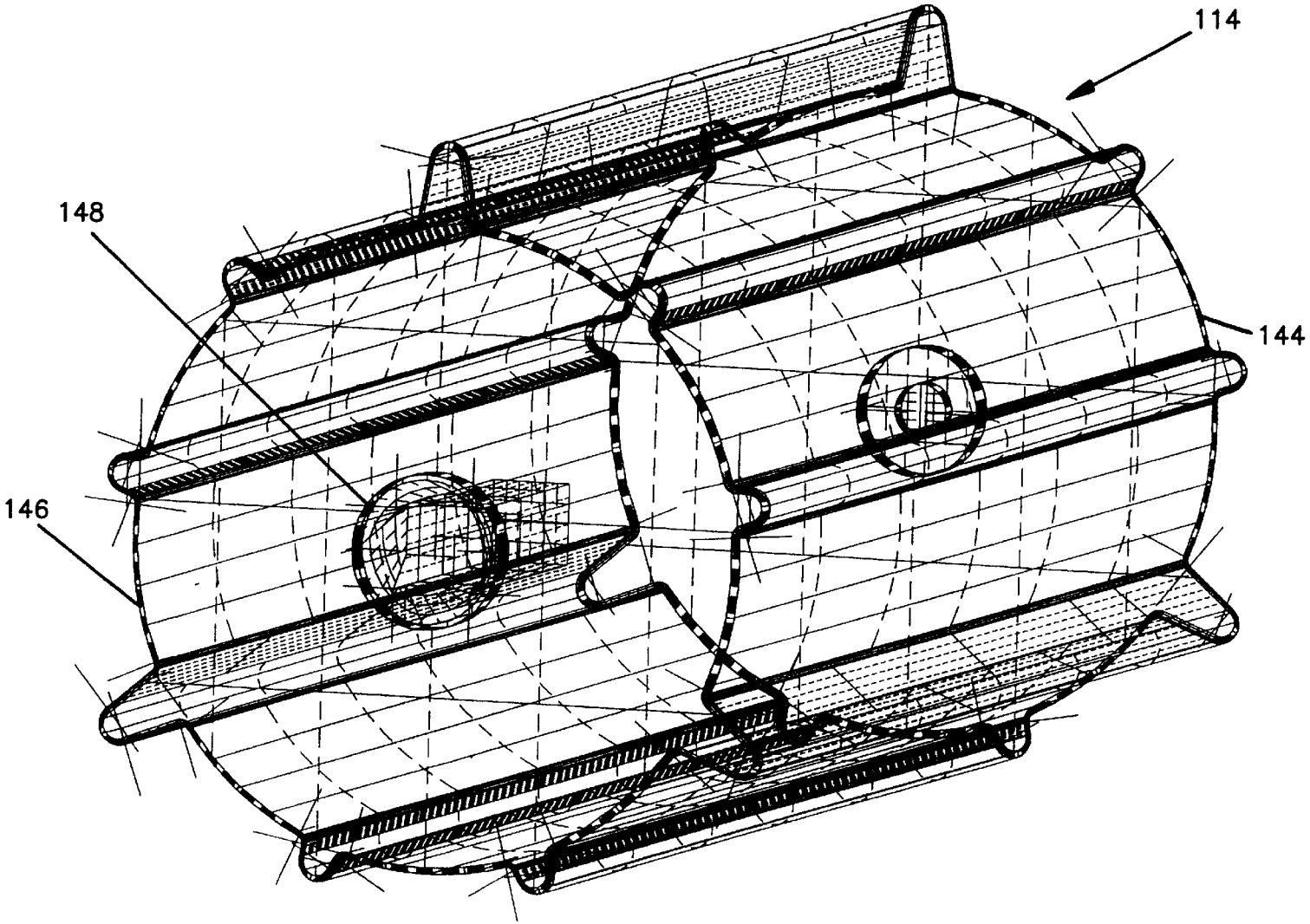
FIG. 8B is a perspective view of the dispensing drum viewing from the opposite end of FIG. 8A.
Figure 8C:
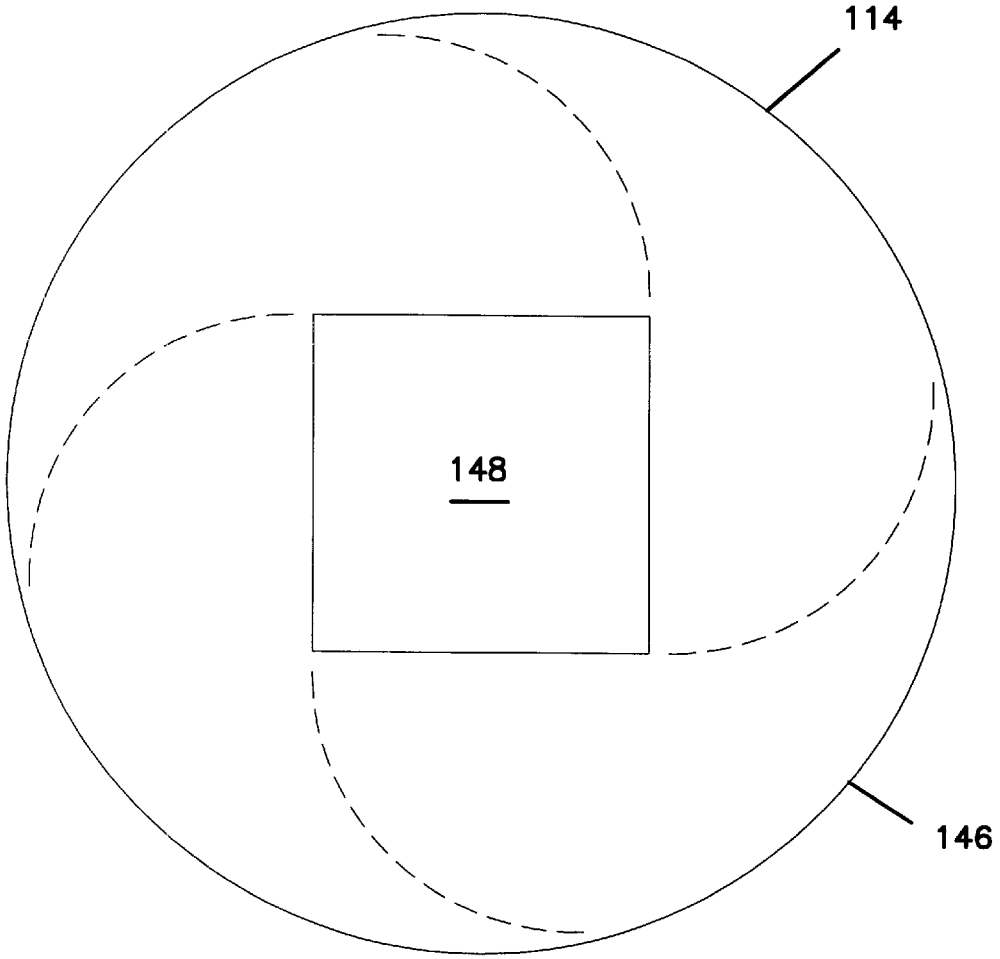
FIG. 8C is a schematic end view of the dispensing drum of FIG. 8B.

FIGS. 8A,B illustrate a preferred embodiment of the drum 114. FIG. 8A shows a first end 144 of the drum 114, and FIG. 8B shows a second end 146 of the drum 114. The second end 146 of the drum 114 slides onto the motor shaft 136 of the accumulator motor 138. The second end 146 has a bore 148 which is arranged and configured to have a twist entrance for easily mounting the drum 114 onto the drum motor shaft 136. The twist entrance provides a self-alignment for the drum 114 to slide onto the drum motor shaft 136. A schematic view of the twist entrance is shown in FIG. 8C. This self-alignment allows a user to easily place the drum onto the motor shaft without having to reach inside the hopper to adjust the drum position while placing the hopper onto the dispenser apparatus, especially when the hopper contains a full load of articles.

Further in FIGS. 8A,B, the drum 114 is a cylindrical body 149 having raised areas, e.g. ribs 150*a–i*, and land areas, e.g. grooves 152. Preferably, the ribs 150*a–i* have different predetermined heights above the grooves 152 so as to allow different spaces between the diverter 112 and the drum 114. This drum configuration provides a better handling of a variety of articles as well as reduces breakage of the articles during the transfer.

Figure 10:
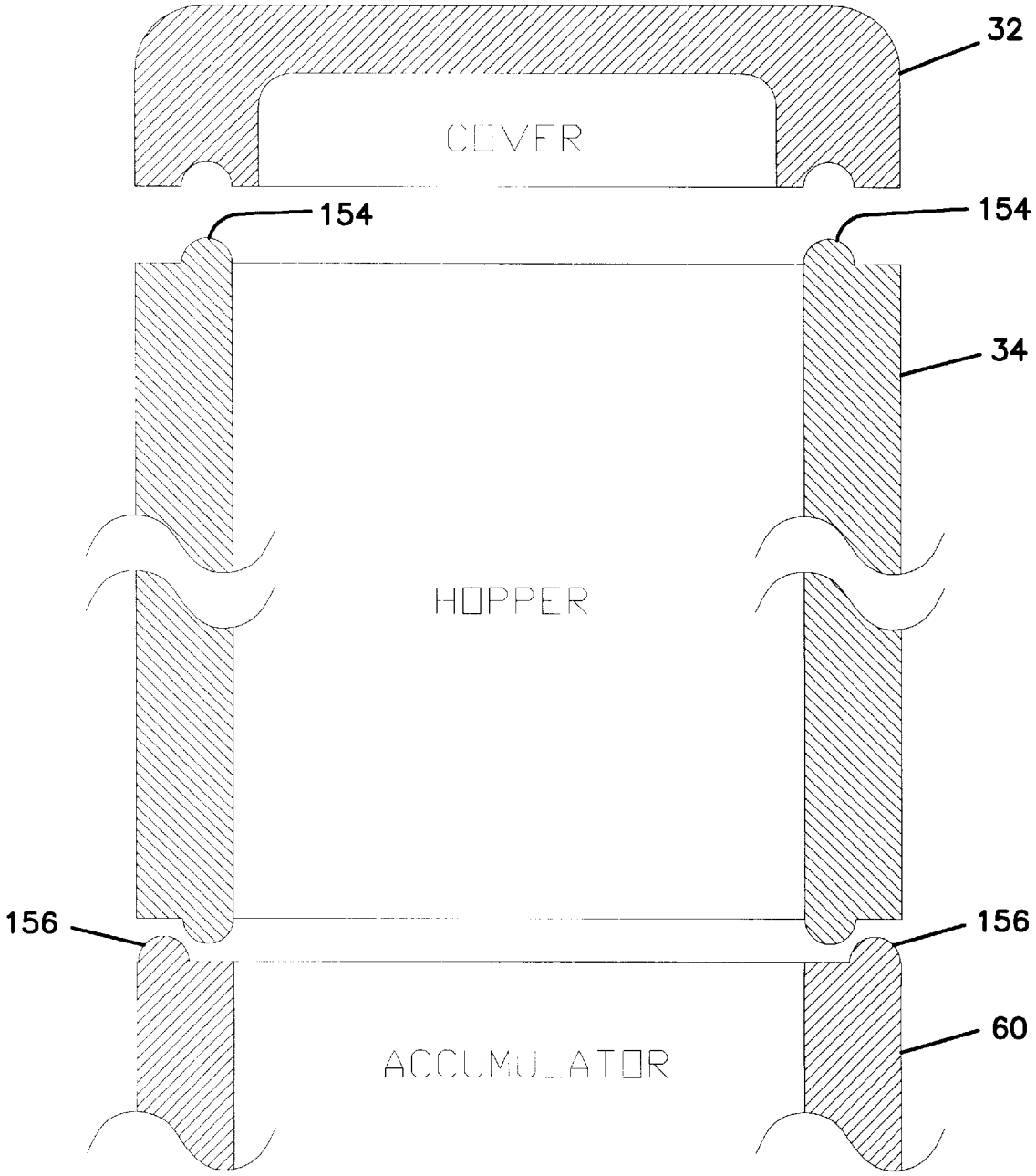
FIG. 10 is a schematic view of one embodiment of air seals between the hopper lid and the hopper body, and between the hopper body and an accumulator.

FIG. 10 illustrates air restricting members 154,156 which are provided between the hopper lid 32 and the hopper body 34 and between the hopper body 34 and the accumulator 60, respectively. When the lid 32 is closed onto the body 34, the air restricting member 154 restricts air flow between the lid 32 and the body 34. Also, after the hopper 22 slides onto the accumulator 60, the air restricting member 156 restricts air flow between the hopper 22 and the accumulator 60. The air restricting members help slow the defrosting/thawing of the frozen articles so as to provide a better handling of articles.

While a particular embodiment of the invention has been described with respect to its application for dispensing articles, such as frozen french fries onion rings, etc., it will be understood by those of skill in the art that the invention is not limited by such application or embodiment for the particular components disclosed and described herein. It will be appreciated by those skilled in the art that other circuit configurations that embody the principles of this invention and other applications therefor can be configured within the spirit and intent of this invention. The circuit configuration described herein is provided as only one example of an embodiment that incorporates and practices the principles of this invention. Other modifications and alterations are well within the knowledge of those skilled in the art and are to be included within the broad scope of the appended claims.

We claim:

1. A diverter apparatus for transferring food articles in a dispenser apparatus, comprising:

a) a plate having mounting slots for mounting the diverter to the dispenser apparatus;

b) a plurality of resilient prongs being located side by side with a predetermined distance from each other and connected to the plate; and c) wherein the position of the diverter apparatus, when mounted to the dispenser apparatus, is adjustable so as to allow larger-sized food articles to be dispensed.

2. The diverter apparatus of claim 1, further including a C-shaped section comprising the plurality of resilient prongs.

3. The diverter apparatus of claim 2, wherein each of the prongs are made of plastic materials.

4. The diverter apparatus of claim 3, wherein the prongs are made of ABS plastic materials.

5. A diverter apparatus for transferring food articles in a dispenser apparatus, comprising:

a) a first section for mounting the diverter apparatus to another surface;

b) a second section depending downwardly from the first section at an angle relative to the first section; and c) a third section, depending from the second section, being arc-shaped, and having a plurality of channels formed therein, wherein the food articles are guided along the third section, and wherein the third section ends in a position substantially parallel to the plane of the first section.

6. The diverter apparatus of claim 5, wherein the first section comprises a plate having mounting slots for mounting the diverter apparatus to the dispenser apparatus.

7. The diverter apparatus of claim 6, wherein the position of the diverter apparatus, when mounted to the dispenser apparatus, is adjustable by using the mounting slots of the first section.

8. The diverter apparatus of claim 5, wherein the plurality of channels are located side by side with a predetermined distance from each.

9. The diverter apparatus of claim 8, further comprising a plurality of prongs, a single prong being located between adjacent channels, and wherein each of the prongs are made of plastic material.

10. The diverter apparatus of claim 9, wherein each of the channels are made of ABS plastic materials.

11. A diverter apparatus for transferring food articles in a dispenser apparatus, comprising:

a) a mounting flange for mounting the diverter apparatus to a support frame, and the mounting flange defining a first mean plane;

b) a plurality of spaced apart fingers, the fingers shaped so as to extend from a second plane and end in a position substantially parallel to the first plane, wherein the food articles are guided along the surface of the plurality of spaced apart fingers; and c) an offset member connecting the mounting flange to the plurality of spaced apart fingers.

12. The diverter apparatus of claim 11, wherein the position of the mounting flange is adjustable so as to allow larger sized food articles to be transferred.

13. The diverter apparatus of claim 11, wherein the fingers are shaped in substantially a C-shaped position.

14. The diverter apparatus of claim 13, wherein the fingers are made of plastic materials.

15. The diverter apparatus of claim 14, wherein the fingers are made of ABS plastic materials.

16. A diverter apparatus for transferring food articles in a dispenser apparatus, comprising:

a) a mounting flange for mounting the diverter apparatus to a support frame, and the mounting flange defining a first mean plane;

b) a plurality of spaced apart fingers, the fingers shaped so as to extend from a second plane and end in a position substantially parallel to the first plane;

c) an offset member connecting the mounting flange to the plurality of spaced apart fingers;

d) wherein the position of the mounting flange is adjustable so as to allow larger sized food articles to be transferred; and e) wherein the fingers are resilient so as to allow a food article to pass through without being broken apart.

17. A diverter apparatus for transferring food articles in a dispenser apparatus, comprising:

a) a first member for mounting the diverter apparatus to another surface;

b) a second member, depending from the first member, being arc-shaped, and having a plurality of channels formed therein, wherein the second member ends in a position substantially parallel to the plane of the first member; and c) a drum positioned in opposing relation to the plurality of channels.

* * * * *